US011295891B2

(12) United States Patent
Venkatadri et al.

(10) Patent No.: US 11,295,891 B2
(45) Date of Patent: Apr. 5, 2022

(54) ELECTRIC COIL STRUCTURE

(71) Applicant: ANALOG DEVICES, INC., Norwood, MA (US)

(72) Inventors: Vikram Venkatadri, Malden, MA (US); David Frank Bolognia, Charlestown, MA (US); Kelvin Po Leung Pun, Hong Kong (HK); Chee Wah Cheung, Hong Kong (HK)

(73) Assignee: Analog Devices, Inc., Wilmington, MA (US)

( * ) Notice: Subject to any disclaimer, the term of this patent is extended or adjusted under 35 U.S.C. 154(b) by 323 days.

(21) Appl. No.: 16/162,660

(22) Filed: Oct. 17, 2018

(65) Prior Publication Data

US 2019/0139695 A1 May 9, 2019

Related U.S. Application Data

(60) Provisional application No. 62/581,557, filed on Nov. 3, 2017.

(51) Int. Cl.
*H01F 27/30* (2006.01)
*H01F 27/24* (2006.01)
(Continued)

(52) U.S. Cl.
CPC ..... *H01F 27/303* (2013.01); *H01F 27/24* (2013.01); *H01F 27/2804* (2013.01);
(Continued)

(58) Field of Classification Search
CPC ..... H01F 27/303; H01F 27/2895; H01F 27/2804; H01F 27/306; H01F 27/24; H01F 27/32; H01F 27/292; H01F 2027/297
See application file for complete search history.

(56) References Cited

U.S. PATENT DOCUMENTS 4,639,707 A * 1/1987 Tanaka ..... H01F 30/16 336/185
4,724,603 A * 2/1988 Blanpain ..... H01F 17/062 29/606
(Continued)

FOREIGN PATENT DOCUMENTS

CN 101770853 7/2010
EP 2388789 A2 11/2011
(Continued)

OTHER PUBLICATIONS

"Ethernet Protection Design Guide", Littelfuse, Inc., (2015), 1-32.
(Continued)

*Primary Examiner* — Mang Tin Bik Lian
(74) *Attorney, Agent, or Firm* — Knobbe, Martens, Olson & Bear LLP

(57) ABSTRACT

In one aspect, an electric coil structure is disclosed. The electric coil structure includes a magnetic core and a substrate. The substrate comprises a conductive material that is embedded in an insulating material. The substrate has a first portion and a second portion and the first portion of the substrate is wrapped around the core. The substrate can have a first portion having a plurality of contacts and a second portion having a corresponding plurality of edge contacts. The coil structure includes an alignment structure. The alignment structure can facilitate attachment of the first portion to the second portion to define a coil about the magnetic core. The alignment structure can comprise a redistribution substrate. The redistribution substrate can be disposed between the first portion and the second portion with the conductive material of the first portion electrically connected to the conductive material of the second portion through the redistribution substrate to define at least one winding. The alignment structure can include an adhesive. The adhesive can be disposed in the recess electrically
(Continued)

connecting the first and second portions to define at least one winding. The coil structure can include a solder joint. The solder joint can be disposed between the plurality of contacts and the corresponding plurality of edge contacts making electrical connections between the first and second portions to define at least one winding such that the solder joint is exposed on the first portion.

21 Claims, 30 Drawing Sheets

(51) Int. Cl.
*H01F 27/32* (2006.01)
*H01F 27/29* (2006.01)
*H01F 27/28* (2006.01)

(52) U.S. Cl.
CPC ..... *H01F 27/2895* (2013.01); *H01F 27/292* (2013.01); *H01F 27/306* (2013.01); *H01F 27/32* (2013.01); *H01F 2027/297* (2013.01)

(56) References Cited

U.S. PATENT DOCUMENTS 4,755,783 A 7/1988 Fleischer et al.
4,975,671 A * 12/1990 Dirks ..... H01F 17/0033 336/200
4,975,672 A * 12/1990 McLyman ..... H01F 17/062 174/DIG. 8
5,425,166 A * 6/1995 Hastings ..... H01F 1/0027 29/423
5,465,272 A 11/1995 Smith
5,994,998 A 11/1999 Fisher et al.
6,188,305 B1 * 2/2001 Chang ..... H01F 17/0033 336/200
6,246,311 B1 * 6/2001 Finnemore ..... H01F 17/062 336/192
6,408,032 B1 6/2002 Lye et al.
6,433,608 B1 8/2002 Huang
6,541,878 B1 4/2003 Diab
6,573,820 B2 * 6/2003 Yamada ..... H01F 27/2804 336/184
6,841,855 B2 1/2005 Jaeck et al.
7,136,421 B2 11/2006 Lin et al.
7,215,720 B2 5/2007 Yeh
7,218,687 B2 5/2007 Huang et al.
7,304,863 B1 12/2007 Wu
7,445,507 B1 11/2008 Parker
7,697,251 B2 4/2010 Karam
7,944,668 B2 5/2011 Huang et al.
8,098,768 B2 1/2012 Langner et al.
8,543,190 B2 9/2013 Wasson et al.
9,491,008 B2 11/2016 Dong
9,721,714 B1 8/2017 Sun et al.
9,906,211 B2 2/2018 Fernández Robayna
10,090,094 B2 10/2018 Bolognia et al.
2003/0025585 A1 * 2/2003 Macerini ..... H01F 27/2804 336/65
2008/0136256 A1 6/2008 Gattani
2008/0137759 A1 6/2008 Cai et al.
2008/0159414 A1 7/2008 Brecher et al.
2008/0159415 A1 7/2008 Miller et al.
2009/0160596 A1 * 6/2009 Yang ..... H01F 27/2804 336/84 C
2009/0202003 A1 8/2009 Langner et al.
2009/0207538 A1 8/2009 Crawley et al.
2010/0150285 A1 6/2010 Tazebay et al.
2011/0285492 A1 * 11/2011 Wang ..... H01F 27/306 336/198
2013/0339765 A1 12/2013 Diab
2014/0232502 A1 * 8/2014 Gutierrez ..... H01F 27/306 336/200
2015/0332836 A1 11/2015 Lee
2016/0111199 A1 * 4/2016 Quilici ..... H01F 27/306 336/200
2016/0181007 A1 * 6/2016 Shiokawa ..... H01F 41/08 336/221
2016/0285354 A1 * 9/2016 Handy ..... H01F 27/323
2017/0250682 A1 8/2017 Fernández Robayna
2017/0346661 A1 11/2017 Mccarthy et al.
2017/0352469 A1 12/2017 Bolognia et al.

FOREIGN PATENT DOCUMENTS

TW 486901 5/2002
WO WO 2017/068423 A1 4/2017
WO WO 2017/205478 11/2017

OTHER PUBLICATIONS

International Application Serial No. PCT/IB2016/001629, International Preliminary Report on Patentability dated Apr. 24, 2018, 6 pgs.
International Application Serial No. PCT/IB2016/001629, International Search Report dated Feb. 28, 2017, 4 pgs.
International Application Serial No. PCT/IB2016/001629, Written Opinion dated Feb. 28, 2017, 5 pgs.
International Application Serial No. PCT/US2017/034202, International Search Report dated Sep. 14, 2017, 6 pgs.
International Application Serial No. PCT/US2017/034202, Written Opinion dated Sep. 14, 2017, 6 pgs.
Siegel, Adam C., "Foldable Printed Circuit Boards on Paper Substrates", Advanced Function Materials, 20, (2010), 28-35.
U.S. Appl. No. 15/164,267, Examiner Interview Summary dated Jan. 10, 2018, 3 pgs.
U.S. Appl. No. 15/164,267, Examiner Interview Summary dated Jul. 17, 2017, 3 pgs.
U.S. Appl. No. 15/164,267, Final Office Action dated Nov. 2, 2017, 25 Pages.
U.S. Appl. No. 15/164,267, Non Final Office Action dated Feb. 2, 2018, 26 pages.
U.S. Appl. No. 15/164,267, Non Final Office Action dated Jun. 9, 2017, 19 pages.
U.S. Appl. No. 15/164,267, Response filed Apr. 20, 2018 to Non Final Office Action dated Feb. 2, 2018, 11 pgs.
U.S. Appl. No. 15/164,267, Response filed Jan. 9, 2018 to Final Office Action dated Nov. 2, 2017, 12 pgs.
U.S. Appl. No. 15/164,267, Response filed Jul. 20, 2017 to Non Final Office Action dated Jun. 9, 2017, 11 pgs.
U.S. Appl. No. 15/226,564, Examiner Interview Summary dated Feb. 6, 2017, 3 pgs.
U.S. Appl. No. 15/226,564, Non Final Office Action dated Dec. 23, 2016, 11 pgs.
U.S. Appl. No. 15/226,564, Notice of Allowance dated Mar. 3, 2017, 6 pgs.
U.S. Appl. No. 15/226,564, Notice of Allowance dated Nov. 7, 2017, 5 pgs.
U.S. Appl. No. 15/226,564, Response filed Feb. 2, 2017 to Non Final Office Action dated Dec. 23, 2016, 14 pages.
Weon, Dae-Hee, et al., "3-D Integrated Inductors and Transformers on Liquid Crystal Polymer Substrate", IEEE, (2006), 1381-1384.
Office Action issued in Chinese application No. 201811307135.7 dated Sep. 23, 2020.
Office Action issued in Chinese Application No. 201811307135.7, dated Aug. 4, 2021.
Supplemental Search Report in Chinese Application No. 201811307135.7, dated Jul. 29, 2021.

* cited by examiner

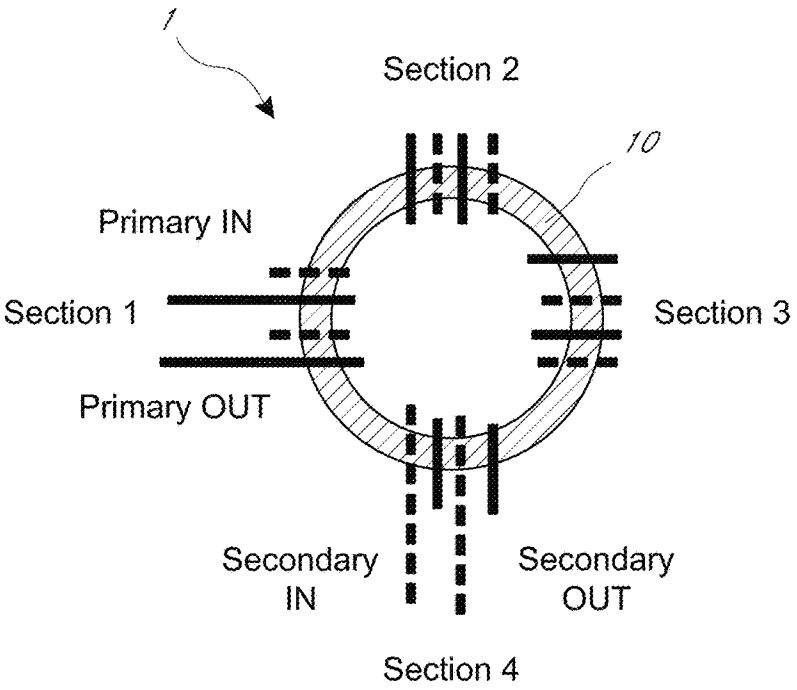
FIG. 1B
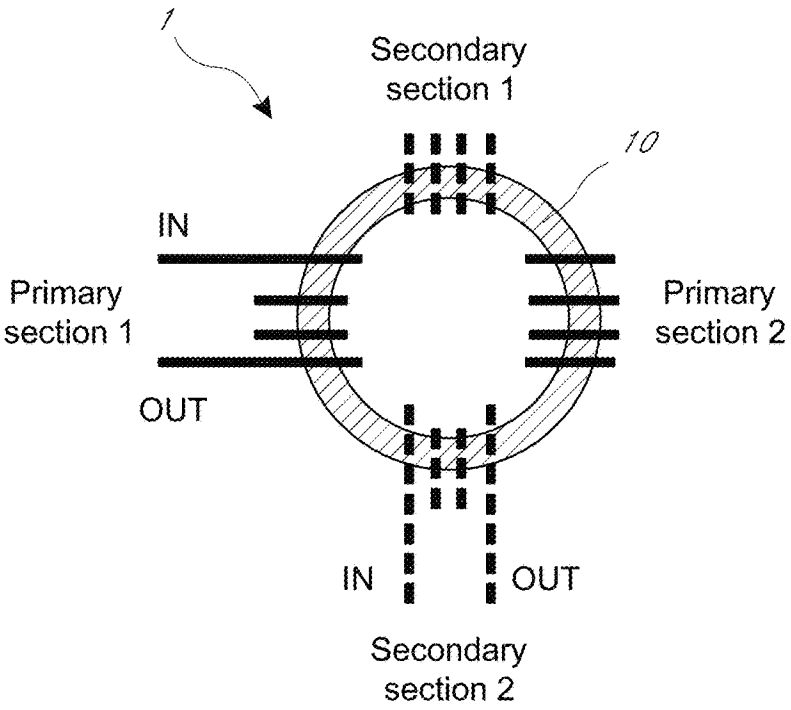
FIG. 1A
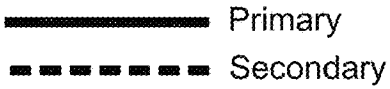

ELECTRIC COIL STRUCTURE

CROSS-REFERENCE TO RELATED APPLICATIONS

This application claims the benefit of U.S. Provisional Application No. 62/581,557 entitled "ELECTRIC COIL STRUCTURE," filed Nov. 3, 2017, the entire disclosure of which is incorporated herein by reference for all purposes.

This application is also related to U.S. patent application Ser. No. 15/174,477 entitled "FLEX-BASED SURFACE MOUNT TRANSFORMER" filed Jun. 6, 2017, the entire disclosure of which is incorporated herein by reference for all purposes.

BACKGROUND

Field

The field relates to electric coil structures, more particularly to coils wrapped around magnetic cores, such as inductors or transformers.

Description of the Related Art

Transformers are devices used to change the voltage of alternating current. Inductors store electrical energy in a magnetic field. In both devices, coils of wires around a magnet core are often used. Because coil winding can be a time-consuming process, commercial transformer design is primarily driven by cost. Coil-winding is generally performed manually or using a semi-automatic process, which is not convenient for high volume manufacturing.

Accordingly, a need exists for more cost-effective manufacture of transformers and inductors, particularly for standalone or surface mount devices.

SUMMARY

In one aspect, an electric coil structure is disclosed. The electric coil structure includes a magnetic core and a coil substrate. The coil substrate includes a conductive material that is embedded in an insulating material. The coil substrate has a first portion and a second portion. The first portion of the coil substrate is at least partially wrapped around the magnetic core. The electric coil structure also includes an alignment structure. The alignment structure is configured to facilitate attachment of the first portion to the second portion to define a coil about the magnetic core.

In one embodiment, the electric coil structure is a transformer.

In one embodiment, the electric coil structure is a surface mount electronic device.

In one embodiment, the magnetic core has an annular shape.

In one embodiment, the coil substrate includes polyimide.

In one embodiment, the alignment structure includes recesses at the first portion and protrusions at the second portion disposed in the corresponding recesses.

In one embodiment, the alignment structure includes an adhesive layer disposed between the first portion and the second portion. The adhesive layer can include Ajinomoto Bonding Film (ABF) or Temperature Sensitive Adhesive (TSA).

In one embodiment, the alignment structure includes an alignment hole at a tip of the second portion configured to receive a guide pin during assembly.

In one embodiment, the alignment structure includes a redistribution substrate disposed between the first portion and the second portion. The alignment structure can further include a locking feature at an edge of the redistribution substrate. In one embodiment, the alignment structure includes an edge contact formed on the first portion of the coil substrate.

In one embodiment, the coil substrate includes multiple segments, the second portion of the coil substrate includes a base, and the first portion of the coil substrate includes the segments extending from the second portion. The second portion can include a spine and legs extending from the spine.

In one embodiment, the alignment structure includes a hole in the second portion and a corresponding guide pin in the second portion.

In one aspect, an electric coil structure is disclosed. The electric coil structure includes a magnetic core and a coil substrate. The coil substrate comprises a conductive material that is embedded in an insulating material. The coil substrate has a first portion and a second portion. The first portion of the coil substrate is at least partially wrapped around the magnetic core. The electric coil structure also includes a means for at least partially guiding attachment of the first portion to the second portion to define a coil about the magnetic core.

In one embodiment, the means for guiding includes recesses at the first portion and protrusions at the second portion disposed in the corresponding recesses.

In one embodiment, the means for guiding includes an adhesive layer disposed between the first portion and the second portion.

In one embodiment, the means for guiding includes an alignment hole at a tip of the second portion configured to receive a guide pin during assembly.

In one embodiment, the means for guiding includes a redistribution substrate disposed between the first portion and the second portion, and the redistribution substrate includes a locking feature at an edge of the redistribution substrate.

In one embodiment, the coil substrate includes multiple segments, the second portion of the coil substrate includes a base, the first portion of the coil substrate includes the segments extending from the second portion, and the second portion includes a spine and legs extending from the spine.

In one aspect, an electric coil structure is disclosed. The electric coil structure includes a magnetic core and a coil substrate. The coil substrate includes a conductive material that is embedded in an insulating material. The coil substrate has a first portion and a second portion. The first portion of the substrate is at least partially wrapped around the core. The electric coil structure also includes a conductive adhesive that electrically connects the first portion and the second portion. The electric coil structure further includes a nonconductive material layer disposed between the first portion and the second portion. The first portion and the second portion of the coil substrate define at least one winding around the magnetic core.

In one embodiment, the nonconductive material layer includes a nonconductive adhesive. The first portion can include a protrusion and the second portion includes a recess that receives the protrusion.

In one embodiment, the electric coil structure further includes conductive traces in or on the nonconductive material layer. The conductive traces and the nonconductive material layer can define a redistribution substrate.

In one embodiment, the first portion of the coil substrate includes edge contacts.

In one aspect, an electric coil structure is disclosed. The electric coil structure includes a magnetic core and a coil substrate. The coil substrate includes a conductive material that is embedded in an insulating material. The coil substrate has a first portion and a second portion. The first portion of the substrate is wrapped around the core. The electric coil structure also includes a redistribution substrate that is disposed between the first portion and the second portion. The conductive material of the first portion is electrically connected to the conductive material of the second portion through the redistribution substrate to define at least one winding.

In one embodiment, the electric coil structure is a transformer.

In one embodiment, the electrical coil structure is a surface mount electronic device.

In one embodiment, the magnetic core has an annular shape. The magnetic core can have an inner periphery and an outer periphery. The redistribution substrate can have a surface larger than the area defined by the inner periphery of the magnetic core.

In one embodiment, the coil substrate includes polyimide.

In one embodiment, the coil substrate includes multiple segments. Each of the multiple segments at least partially wraps around the magnetic core with the conductive material electrically connected to form a helix. The first portion can include one of the segments and the second portion can include a base from which the multiple segments extend.

In one embodiment, the conductive material includes a conductive wire.

In one embodiment, the conductive material includes a plurality of traces embedded in the coil substrate.

In one embodiment, the redistribution substrate includes a recess and the second portion of the coil substrate includes a protrusion that is disposed in the recess.

In one embodiment, the electric coil structure also includes an adhesive between the redistribution substrate and the second portion of the coil substrate. The adhesive can include Ajinomoto Bonding Film (ABF) or Temperature Sensitive Adhesive (TSA).

In one embodiment, the second portion includes a first hole configured to receive a guide pin for aligning the first portion of the coil substrate relative to the redistribution substrate. A first segment can be defined by the first portion of the coil substrate. The coil substrate can also include a second segment different from the first segment that is defined by a third portion of the coil substrate, which includes a second hole that is configured to receive the guide pin. The second segment can wrap around the magnet core. The third portion of the coil substrate can be electrically connected to the redistribution substrate.

In one embodiment, the redistribution substrate and the second portion of the coil substrate are electrically connected by a solder joint. The solder joint can electrically connect a plurality of contacts of the redistribution substrate and a corresponding plurality of edge contacts of the second portion of the coil substrate. The solder joint can be exposed on the redistribution substrate.

In one aspect, an electric coil structure is disclosed. The electric coil structure includes a magnetic core and a coil substrate. The coil substrate includes a conductive material that is embedded in an insulating material. The coil substrate has a first portion including segments and a second portion including a spine that has a first side and a second side that is opposite the second side. The segments extends from a first side of the spine. The coil substrate is wrapped around the core with the first portion electrically connected to the second portion to define at least one coil about the core. The spine is disposed generally parallel with a surface of the magnetic core.

In one embodiment, the first portion and the second portion are electrically connected by a conductive adhesive. The electric coil structure also includes a non-conductive second adhesive between the first portion and the second portion. The conductive adhesive has a greater adhesive strength than the non-conductive second adhesive.

In one embodiment, the first portion also includes legs extending from the second side of the spine.

In one embodiment, the electric coil structure also includes a redistribution substrate disposed between the first portion and the second portion of the coil substrate.

In one embodiment, the first portion includes protrusions that is disposed into corresponding recesses defined at the second portion.

In one embodiment, the segments of the first portion include edge contacts. The edge contacts exposing electrical connections between the first portion and the second portion.

In one aspect, an electric coil structure is disclosed. The electric coil structure includes a magnetic core and a coil substrate. The coil substrate includes a conductive material that is embedded in an insulating material. The coil substrate has a first portion having a plurality of contacts and a second portion having a corresponding plurality of edge contacts. The coil substrate is wrapped around the core. The electric coil structure also includes a solder joint that is disposed between the plurality of contacts and the corresponding plurality of edge contacts making electrical connections between the first and second portions to define at least one winding. The solder joint is exposed on the first portion.

BRIEF DESCRIPTION OF THE DRAWINGS

Specific implementations will now be described with reference to the following drawings, which are provided by way of example, and not limitation.

FIG. 1A shows a schematic top view of an interleaved design of a transformer.

FIG. 1B shows a schematic top view of an interlaced or intertwined design of a transformer.

DETAILED DESCRIPTION

Figure 2:
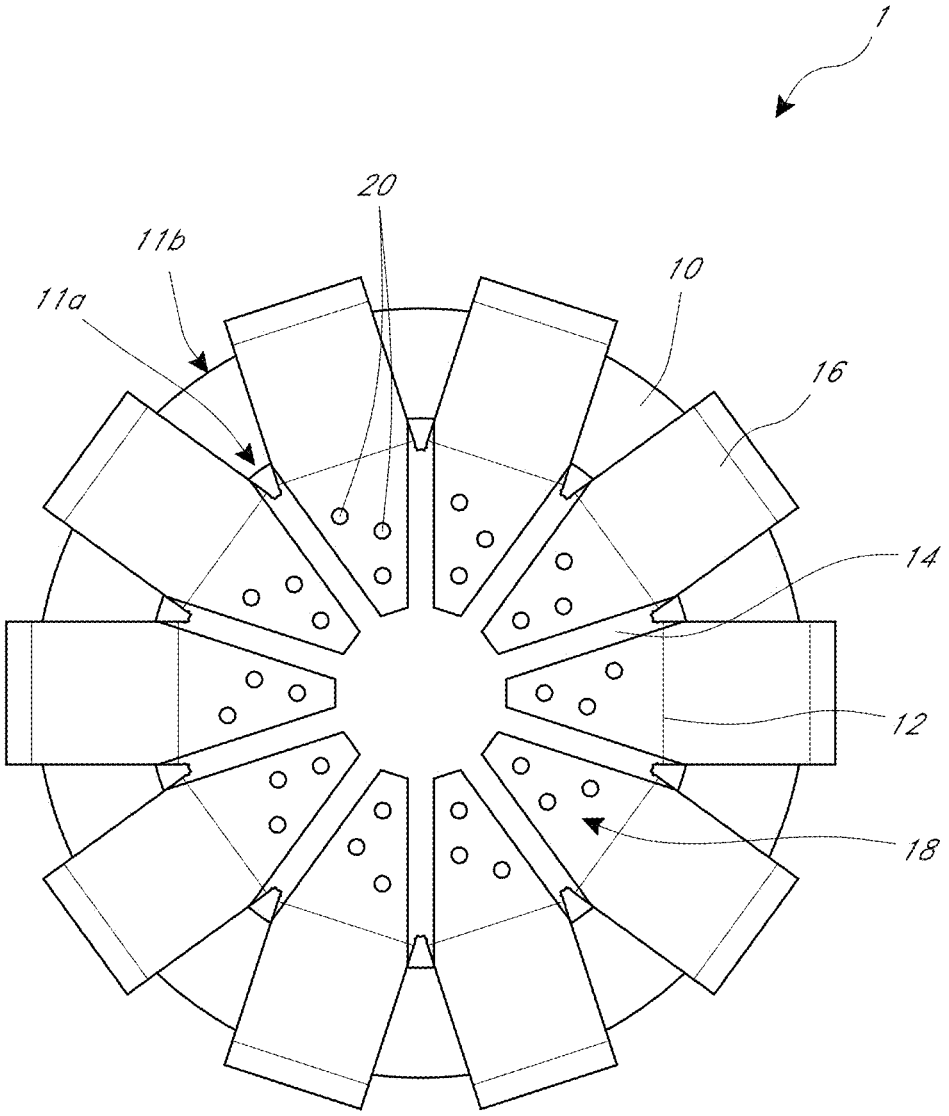
FIG. 2 is a schematic top view of a transformer in one embodiment.

A surface mount electric coil structure based upon a flexible substrate can be, for example, a transformer or inductor. As an example, a flexible substrate including conductive regions (e.g., conductors) can be used to form the windings/wires of the transformer by wrapping around a magnetic core body (e.g., an annular ferrite), and bonding to itself or another substrate to electrically connect the conductors of the flexible substrate to form the windings. Accordingly, the flexible substrate can also be referred to as a coil substrate. The skilled artisan will understand that flexible substrates are so-called due to the construction of the conductors and thin, flexible insulating material (such as polyimide or PEEK) in which they are embedded, and their consequent ability to wrap or bend as desired during assembly of electronic devices or packages incorporating the flexible substrate. Furthermore, such substrates will still be identified as flexible in an assembly even if it is rendered inflexible in a final product, such as by adhesion to a rigid structure and/or encapsulation.

A flexible substrate, also known as "flex," can include multiple conductive layers that include, for example, fine conductive lines or traces. In some embodiments, it can be advantageous to employ a continuous annular or closed shape for the magnetic core, such as an annular ferrite. While the annular shapes of the illustrated embodiments disclosed herein are generally round, the skilled artisan will appreciate that advantages of the annular magnetic core can be obtained with other annular shapes, such as rectangular or other polygonal annular shapes. After the windings are formed around the magnetic core, the flex circuit or other assembly can include pads, such as to facilitate use of the transformer in surface mount technology (SMT) applications or surface mount devices (SMD). For example, input/output (I/O) pads (e.g., solder pads, bumps, or lands) can be placed on an outside surface of a flexible substrate or another portion of a transformer assembly that includes a flexible substrate, resulting in convenient I/O terminals integrated on the outside surface of the transformer. The I/O pads can be used for electrical and mechanical integration on a circuit board, such as by solder, although other means such as anistropic conductive film (ACF) can also be used. The flex-based transformer with an integrated I/O solution can be also used with automatic pick-and-place circuit assembly technologies, as well as reflow at the second level assembly process.

There is a growing need for miniature transformers for use in, for example, Ethernet physical layer (PHY) applications that can be integrated into a package with larger bandwidth and lower insertion loss. Such needs resulted in the development of interleaved (with alternating sections of multiple primary turns with multiple secondary turns) and interlaced (with each section alternating individual primary and secondary turns) designs for transformers where the windings are provided in segments of a flex substrate that are wrapped around a magnetic core. Embodiments such as those described in U.S. patent application Ser. No. 15/174,477 ("the '477 application"), filed Jun. 6, 2017, which is incorporated hereinabove, facilitate a relatively high density of windings in a relatively inexpensive assembly.

In wrapping a flexible substrate around a magnetic core, several difficulties can arise. For example, it can be difficult to maintain alignment of flexible substrate contact pads to other pads on different portions of the flexible substrate or on another substrate, especially with automated high volume manufacturing. Also, conventional solder bonding risks short circuit due to overflow of the solder from one bonding region to another. Further, due to the awkward geometry of the flexible substrate wrapped around a magnetic core, and particularly an annular core, the flexible substrate conceals the bonding region so that it is difficult to visually inspect whether a proper electrical connection was made. In addition, such bonding regions can be relatively small to fit within device packages and/or integrated circuit modules, which can cause difficulties bonding the substrate accurately.

Thus, in some embodiments, temporary adhesion can facilitate proper alignment and bonding. In some embodiments, bonding structures are provided for preventing the short circuit due to overflow of bonding material. In some embodiments, bonding structures are provided for facilitating inspection of the electrical connection.

FIGS. 1A and 1B show two designs of a transformer 1. FIG. 1A shows an interleaved design and FIG. 1B shows an interlaced or intertwined design. The transformer 1 may comprise primary and secondary turns or windings. In some embodiments, for example, the primary turns of the transformer 1 may take power and the secondary turns may deliver power. In the interleaved design, as illustrated in FIG. 1A, the primary turns may be disposed at two primary sections and the secondary turns may be disposed at two secondary sections, where the primary and secondary sections are positioned alternatingly around a core 10. In the interlaced design illustrated in FIG. 1B, four sections are shown with each section having the primary and secondary turns. In some other embodiments, there may be greater or fewer sections of the core 10 for the primary and/or secondary turns to be positioned.

FIG. 2 is a schematic top view of a transformer 1 in one embodiment. In this view, the transformer 1 comprises a flexible substrate 12 that includes a disc-shaped base 14 (second portion) with a plurality of segments 16 (first portions) extending radially outward. The base 14 is visible at a top of the transformer 1 in FIG. 2. In some embodiments, the segments 16 can comprise fingers that extend generally vertically downward from bottom side of the base 14 within an annular (e.g., toroidal) magnetic core 10, wrap around the outside of the core 10, and ends or tips 18 of the segments 16 connect back to the top side of the base 14, as shows in FIG. 2. In other embodiments it is possible that the segments connect in other manners, such as extending from the top of the base around the outside of the core, with tips connecting to the bottom of the base inside the core. The illustrated arrangement, however, has practical advantages for ease of connecting the tips of the segments back to the base. Solder pads (not shown) for external connection are formed in a middle of the segments 16 at a bottom of the magnetic core 10, as will be appreciated from the isometric view from the bottom (solder pad) side below, for example in FIG. 3A. The annular magnetic core 10 comprises an inner periphery 11*a* and an outer periphery 11*b*. Contact portions 20 for making electrical connections between the tips 18 of the segments 16 and the base 14 of the flexible substrate 12 are disposed between the first and second portions, the segments 16 and base 14. However, the contact portions 20 are illustrated on the segments 16 for the sake of explanation. In some embodiments, the flexible substrate 12 can comprise bend lines, which may be thinned, pre-bent or otherwise structured to facilitate and guide the positioning of the bends, formed before wrapping the segments 16 around the core 10 to facilitate the wrapping process.

Figure 3B:
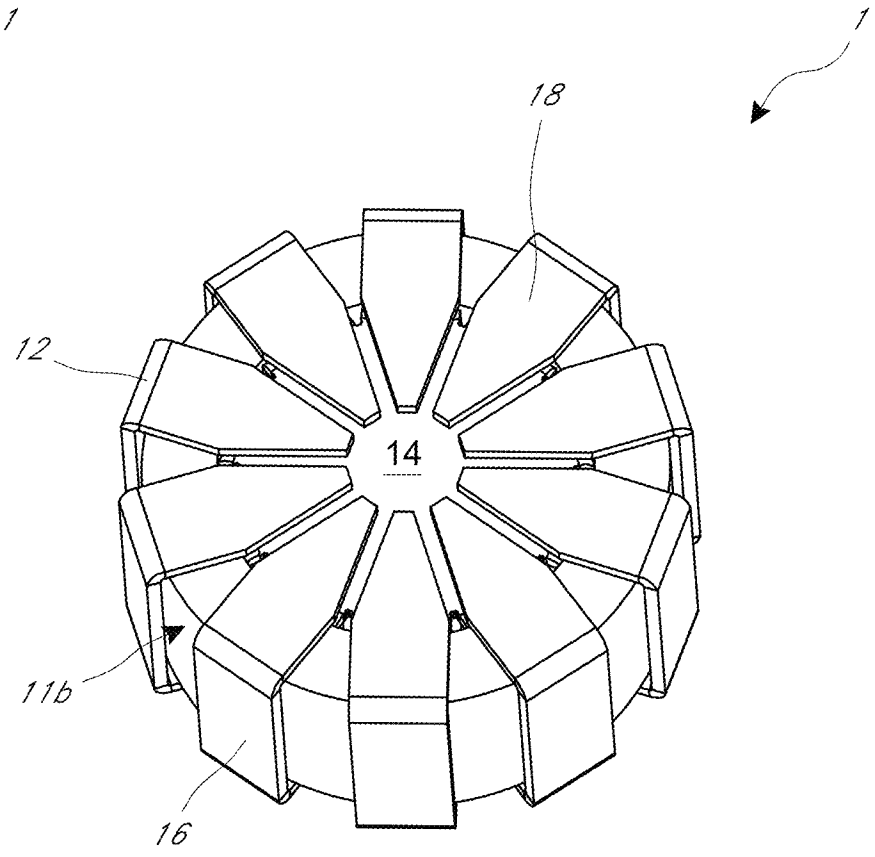
FIG. 3B is a schematic isometric view of the transformer shown in FIG. 3A from a top (flex-to-flex bond) side.
Figure 3A:
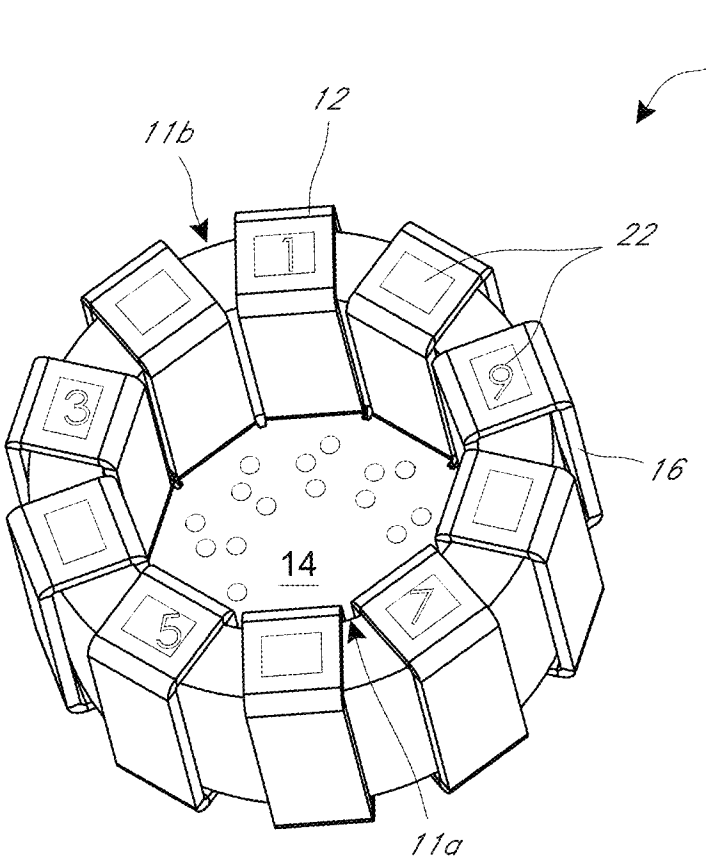
FIG. 3A is a schematic isometric view of a transformer in one embodiment from a bottom (solder pad) side.

FIGS. 3A and 3B are schematic isometric views of a transformer 1 in one embodiment from a bottom (solder pad) side (FIG. 3A) and from a top (flex-to-flex bond) side (FIG. 3B). The view from the bottom side in FIG. 3A shows solder pads 22 in the middle of the segments 16 at the bottom of the transformer 1. The view from the bottom side in FIG. 3A also shows a bottom or a backside of the base 14 (the second portion). The solder pads 22 can be beneficial for surface mounting the transformer 1 to, for example, a printed circuit board (PCB). In some embodiments, there can be two or more solder pads 22 to make electrical connections between the solder pads 22 and the PCB with more than two active pads. In some embodiments, two or more coils can be defined around the core. Embodiments of the transformer 1 illustrated herein includes ten segments 16 extending from the base 14. However, the flexible substrate 12 may have any number of segments 16. In the illustrated embodiment of FIG. 3B, the tips 18 of the segments 16 are individually attached to the top side of the base 14 at the contact portions (not shown). In some embodiments, each tip 18 may have one or more of contacts and the one or more of the contacts of the tip 18 can be connected to corresponding one or more contacts on the base 14.

Figure 4A:
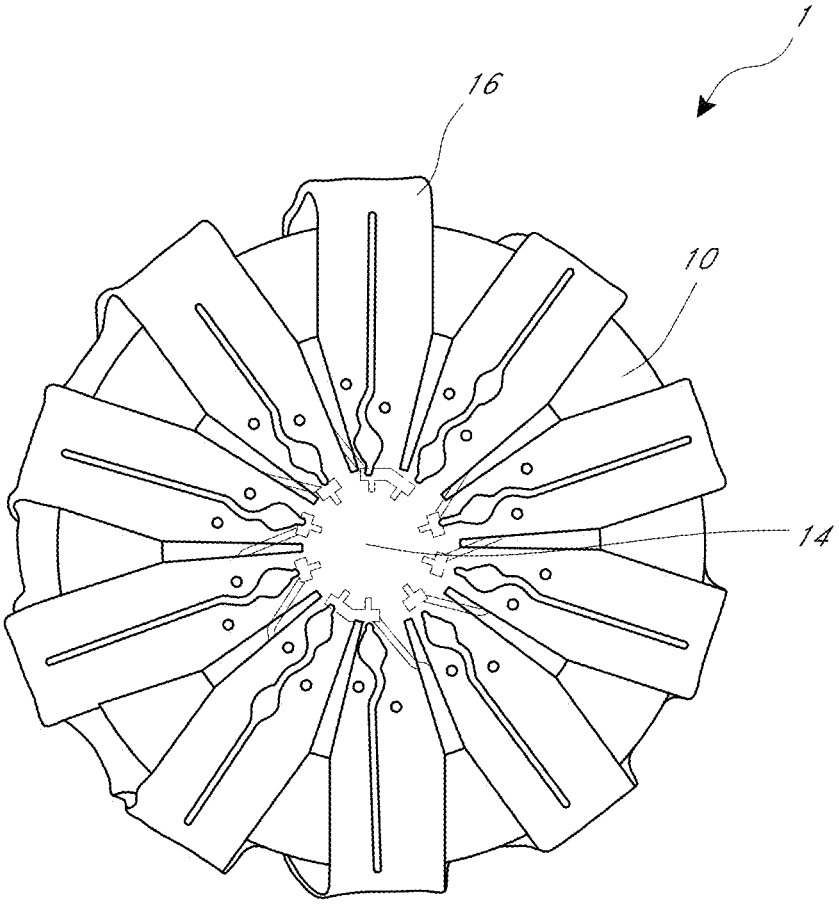
FIG. 4A is a top view of a transformer utilizing a flexible substrate.
Figure 4B:
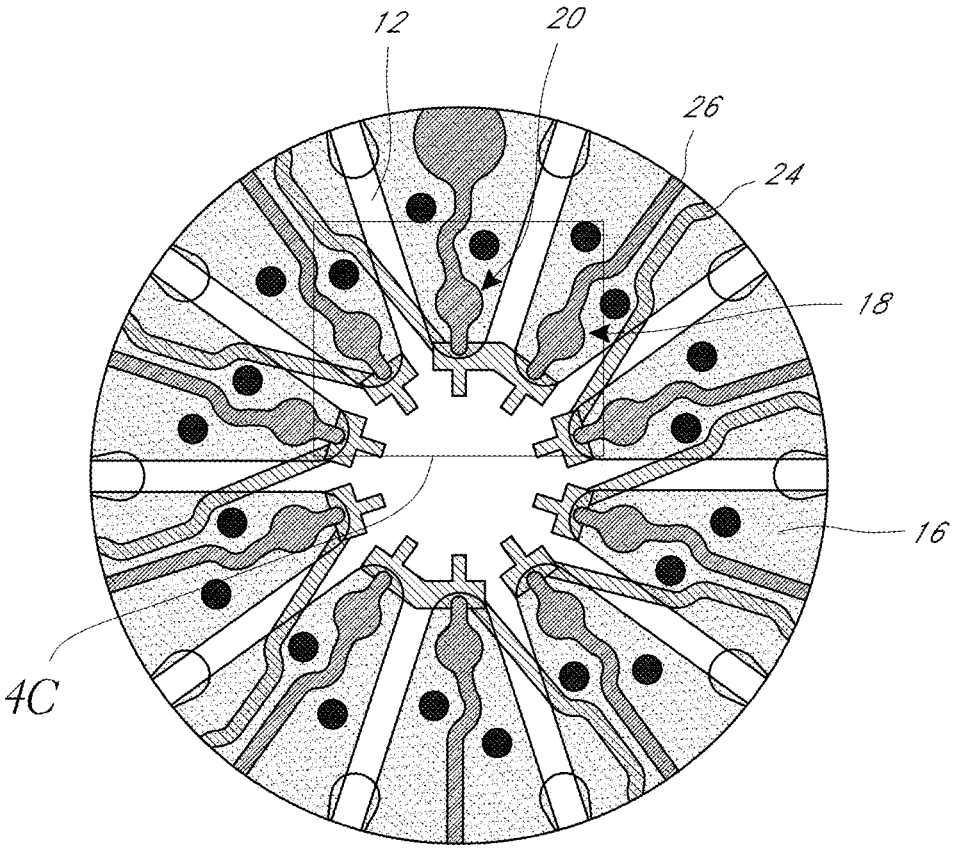
FIG. 4B is a schematic view showing electrical connections of conductive materials in the flexible substrate of the transformer of FIG. 4B.
Figure 4C:
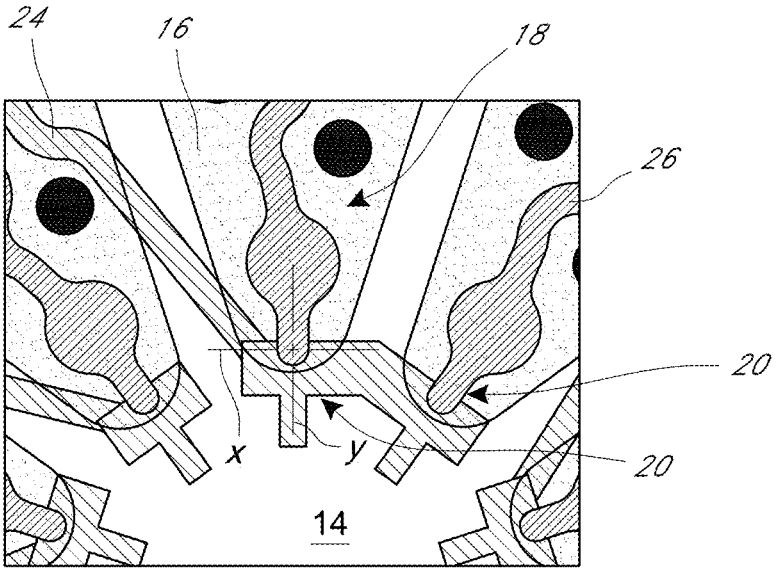
FIG. 4C is a zoomed-in view of a connection portion of FIG. 4B.

FIG. 4A is a top view of a transformer 1 utilizing a flexible substrate 12. FIG. 4B shows electrical connections of conductive materials 24, 26 within the flexible substrate 12 of the transformer 1. FIG. 4C is a zoomed-in view of a portion of FIG. 4B. The conductive materials 24 of the base 14 and the conductive materials 26 of the segments 16 can be connected at the contact portions 20. In some embodiments, the conductive materials 24, 26 may comprise conductive traces embedded on the flexible substrate 12 (or, in other embodiment, intervening redistribution substrate). The tips 18 of the segments 16 (also referred to as legs or fingers) are aligned vertically in FIG. 4C by placing the end of each tip 18 to a conductive line x around a center of a corresponding contact portion 20 of the conductive material 24 of the base 14. The tips 18 can be aligned to a conductive vertical line y (perpendicular to the conductive line x) around the center of the corresponding contact portion 20 of the conductive material 24. In some embodiments, the conductive line x and/or the conductive vertical line y may comprise a copper (Cu) line. The lines x and y serve as alignment markers and in other embodiments need not be conductive. Conductive materials 24 of the base 14 that are under the tips 18 of the segments 16 are illustrated on the tips 18 of the segments 16 to facilitate understanding of the relative locations of the structures.

Figure 5A:
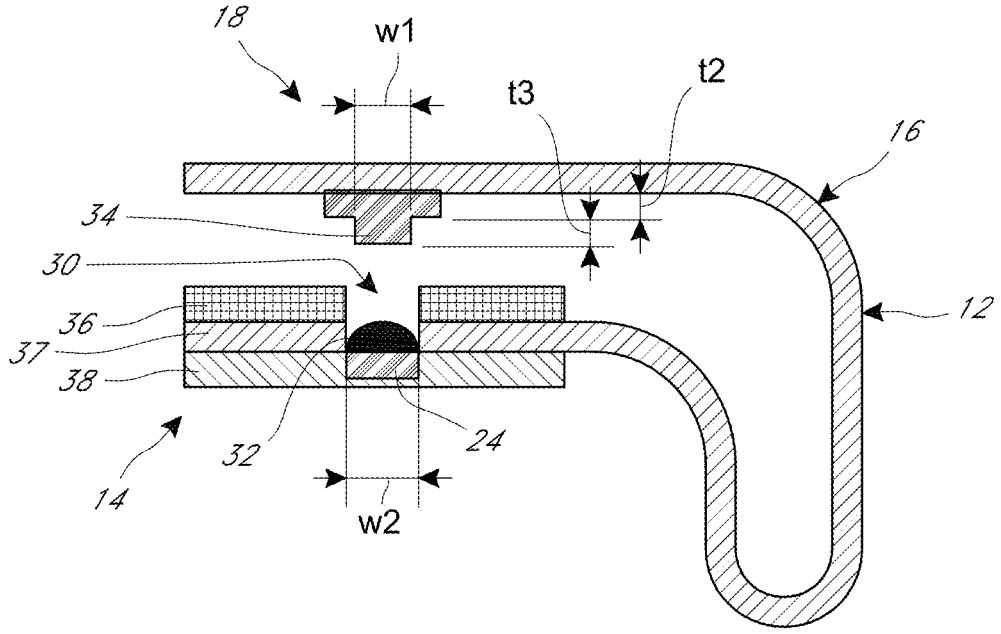
FIG. 5A is a cross sectional side view of a mechanical interlock feature before attachment.
Figure 5B:
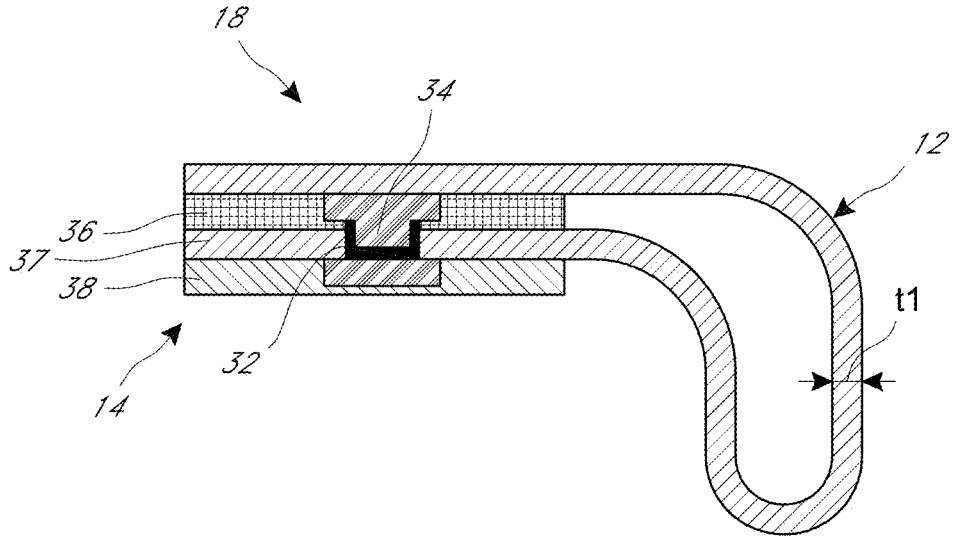
FIG. 5B is a cross sectional side view of the mechanical interlock feature after attachment.

FIGS. 5A and 5B show a mechanical interlock feature. The mechanical interlock feature illustrated, for example, in FIG. 5A can include a recess 30 configured to both confine a permanent adhesive 32 (e.g., solder) therein, and guide the position of a protrusion 34 of the tip 18 of one of the segments 16 of the flexible substrate 12. In the shown embodiment, the recess 30 is defined by another adhesive (e.g., Temperature Sensitive Adhesive (TSA), Ajinomoto Bonding Film (ABF), etc.) layer 36 between the first portion and the second portion of the flexible substrate 12. For example, the second portion of the substrate 12 can be the base 14 portion of the substrate 12, and can include the adhesive layer 36 that at least in part defines the recess or cavity 30 for receiving solder. The segment 16 can be one of the segments (also referred to as fingers) of the flexible substrate 12 that wraps around the magnetic core 10 (see, for example, FIGS. 2-3B), and can include the protrusion 34 (e.g., a conductive protrusion). In some embodiments, the protrusion can comprise a copper post disposed near the tip 18. When the two portions 14, 16 are attached, the recess 30 and the protrusion 34 can guide relative positioning and the adhesive 36 may provide a temporary adhesion to keep the two portions 14, 16 in place relative to each other at least until a solder joint is formed. The permanent adhesive 32 (e.g., solder) can make a permanent adhesion with an electrical connection between the two portions 14, 16. The permanent adhesive 32 does not necessarily adhere the two portions 14, 16 permanently. Rather, the permanent adhesive 32 is so-called to distinguish the adhesive 36, which serves to at least temporarily hold the segments 16 to the base 14 during the more "permanent" adhesion process (e.g., soldering). Therefore, in some embodiment, the two portions 14, 16 may be separated even after the application of permanent adhesive 32. In some embodiments, the permanent adhesive 32 has a greater bonding strength than a bonding strength of the adhesive layer 36. The cavity 30 can additionally prevent the permanent adhesive 32 from overflowing, thus preventing short circuit on the substrate 12. As illustrated in FIGS. 5A and 5B, the recess 30 may also be defined at least in part by a portion of the substrate 12. For example, a nonconductive layer 37 (e.g., polyimide) of the substrate 12 may have an opening to expose the conductive materials 24 of the base 14, and that opening can be aligned with the opening in the adhesive layer 36, as shown in FIGS. 5A and 5B. In such embodiments where the recess 30 is defined by the portion of the substrate 12, the adhesive layer may be omitted, which does not provide the temporary adhesion to keep the two portions 14, 16 in place relative to each other but it still guides relative positioning between the two positions 14, 16. The substrate can comprise another insulating layer 38, such as a solder mask, solder stop mask or solder resist (SR) layer. The insulating layer 38 may prevent or mitigate the conductive materials 24, 26 from oxidizing.

Though the mechanical interlock feature illustrated in, for example, FIGS. 5A and 5B has the recess 30 at the base 14 and the protrusion 34 at the tip 18 of the segment 16, in some embodiments, a recess may be formed at the tip of the segment and the protrusion may be formed at the base.

The nonconductive layer 37 of the substrate 12 can have a thickness t1 of about 25 μm. The thickness t1 of the nonconductive layer 37 may be in a range of 15 μm to 35 μm, for example, 20 μm to 30 μm. The conductive materials 24, 26 of the substrate 12 can have a thickness t2 of about 25 μm. The thickness t2 of the conductive materials 24, 26 may be in a range of 15 μm to 35 μm, for example, 20 μm to 30 μm. The protrusion 34 can have a thickness t3 of about 25 μm. The thickness t3 of the protrusion 34 may be in a range of 15 μm to 35 μm, for example, 20 μm to 30 μm. The protrusion 34 can have a protrusion width w1 of about 50 μm. The protrusion width w1 of the protrusion 34 may be in a range of 40 μm to 60 μm, for example, 45 μm to 55 μm. The opening of the nonconductive layer 37 of the substrate 12 can have an opening width w2 of about 60 μm. The opening width w2 may be in a range of 80 μm to 50 μm, for example, 70 μm to 60 μm, etc. In some embodiments, the opening may have a wider width at a top portion of the opening than a bottom portion of the opening. In some embodiments, the top portion of the opening may have the opening width w2 of about 70 μm and the bottom portion of the opening may have the opening width w2 of about 60 μm.

Figure 5C:
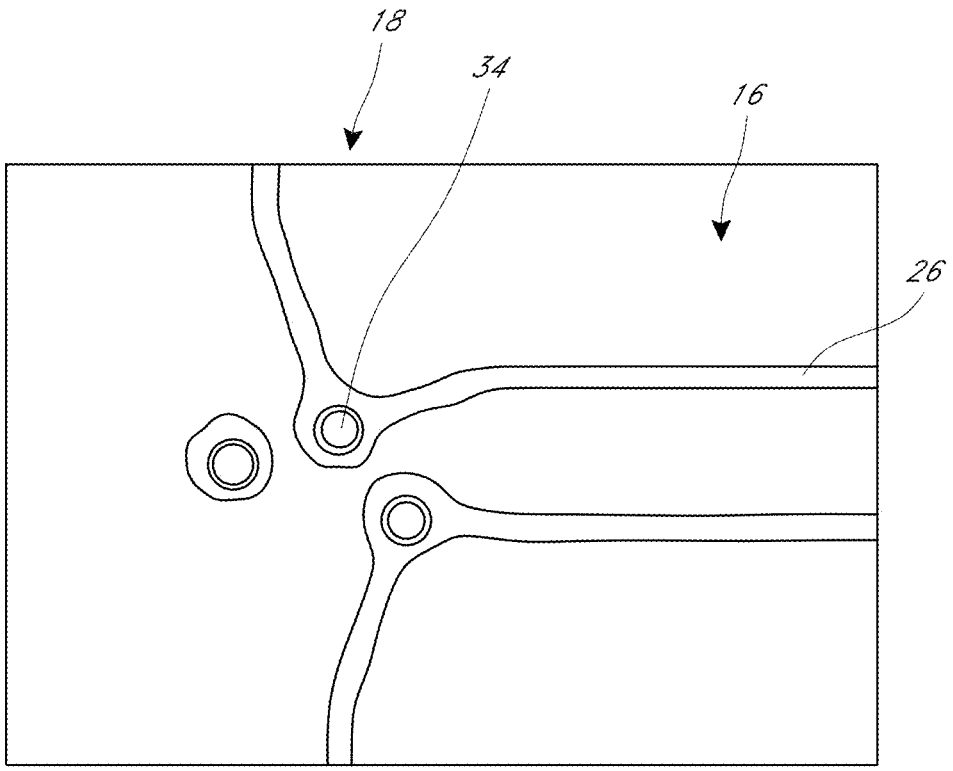
FIG. 5C shows a bottom plan view of a tip or an end of a substrate segment that connects to the base having three protrusions shown in FIG. 5A.
Figures 5D, 5E:
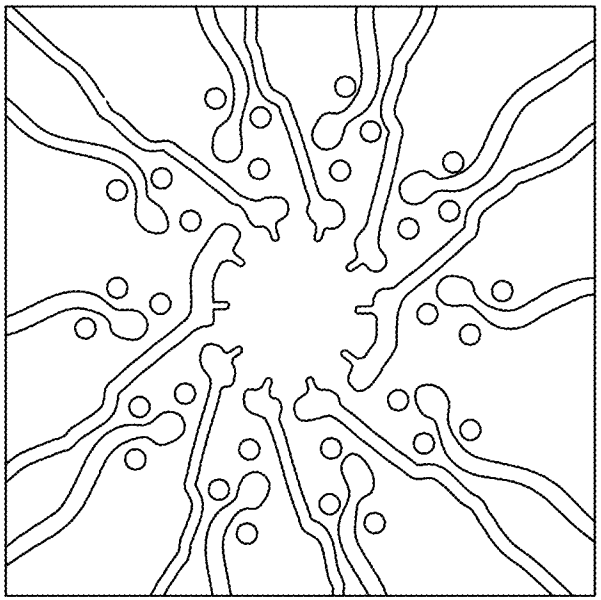
FIG. 5D shows a top plan view of the base of the flexible substrate shown in FIG. 5A before disposing a permanent adhesive.
FIG. 5E shows a top plan view of the base of the flexible substrate shown in FIG. 5A after disposing the permanent adhesive.

FIG. 5C shows a bottom plan view of the tip 18 of one of the segments 16 of the substrate 12 shown in FIG. 5A. There are three protrusions 34 formed on the tip 18. The protrusions 34 may have electrical connections with the conductive materials 26 (e.g., traces) on or embedded in the substrate 12. FIG. 5D shows a top plan view of the base 14 of the substrate 12 shown in FIG. 5A before disposing the permanent adhesive 32 (e.g., solder). FIG. 5E shows a top plan view of the base 14 of the substrate 12 shown in FIG. 5A after disposing the permanent adhesive 32 (e.g., solder).

Figure 6:
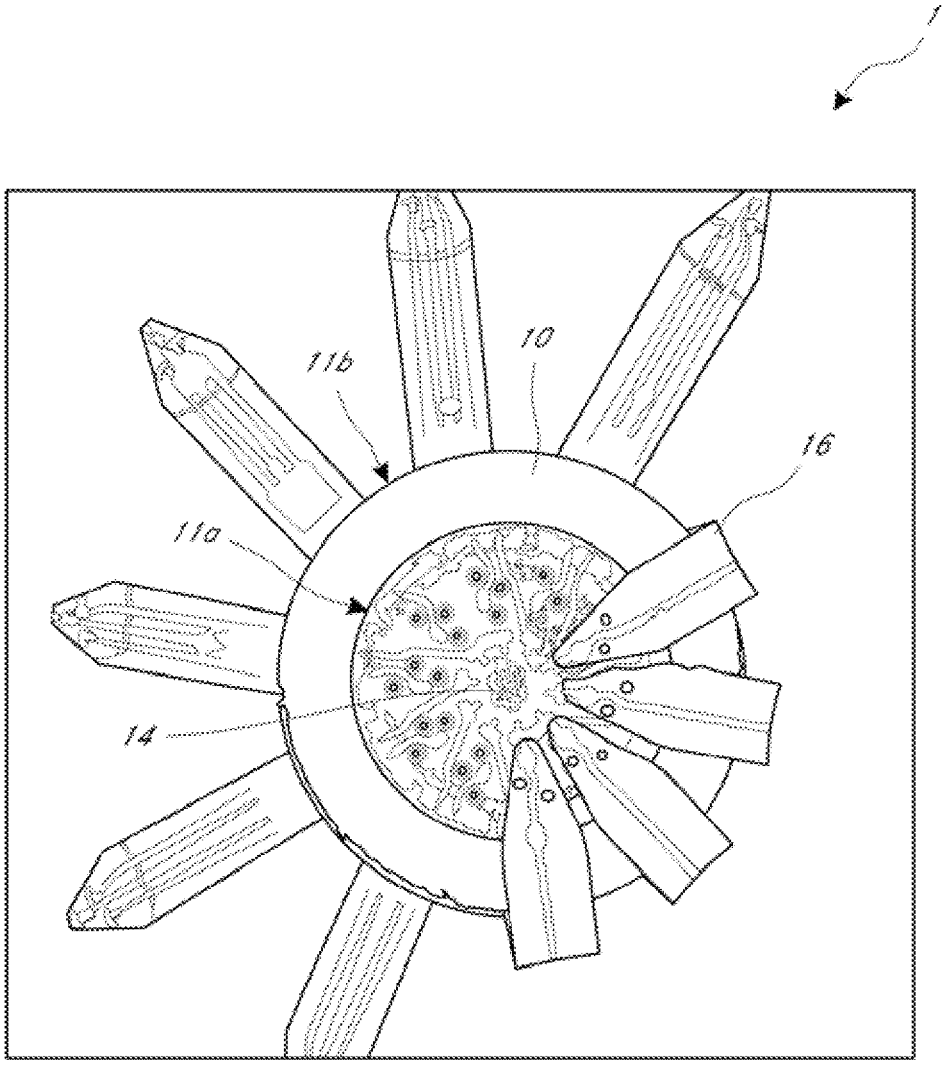
FIG. 6 is a picture showing a top view of a transformer in a stage of manufacturing process in one embodiment.

FIG. 6 is a picture showing a top view of a transformer 1 in a stage of manufacturing process in one embodiment, where four segments 16 extend downwardly through the middle of the annular (toroidal) magnetic core 10, wrap outwardly and upwardly around the core 10 and connect to the top side of the base 14. The flexible substrate 12 may not stay in place by itself after wrapping around the magnetic core 10. In other words, the segments 16 may spring out from the top side of the base 14. Thus, the mechanical interlock feature explained above helps keep the substrate 12 in position after wrapping and before adhesion (for example, soldering), by way of the adhesive layer 36 (see, for example, FIGS. 5A and 5B). In some embodiments, such temporary adhesion can help more precise alignment than without the adhesive.

Figure 7:
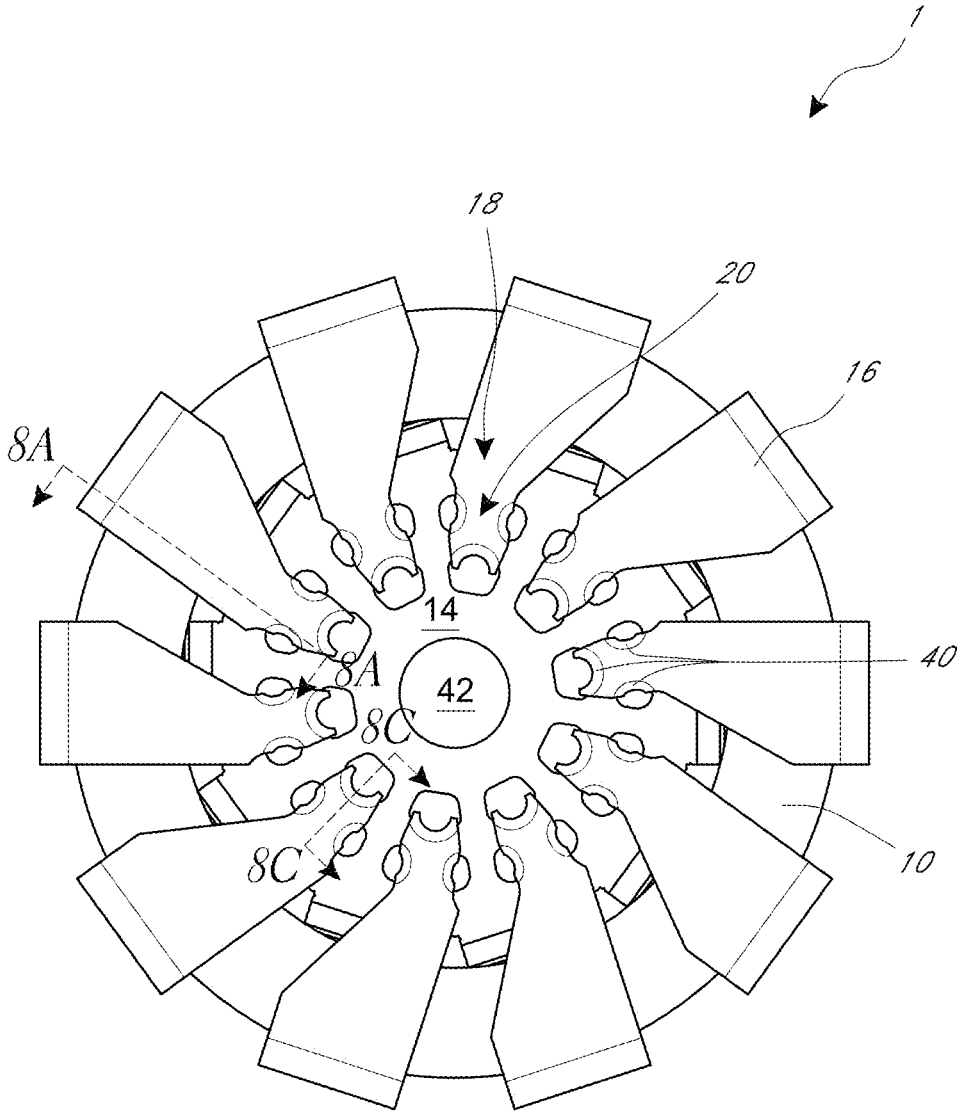
FIG. 7 shows a schematic top plan view of a transformer in one embodiment prior to making electrical connections.

FIG. 7 shows a schematic top plan view of a transformer 1 in one embodiment prior to making electrical connections. This embodiment includes edge contacts 40 on the tips 18 of the segments 16 (first portions) for forming visible connections between the first and second portions 16, 14 at the contact portions 20. As shown in FIG. 7, the base 14 may have a hole 42 in the middle of the base 14. A skilled artisan would appreciate that such embodiment of the base 14 may be applied to any embodiments of the transformer 1 disclosed herein.

Figure 8B:
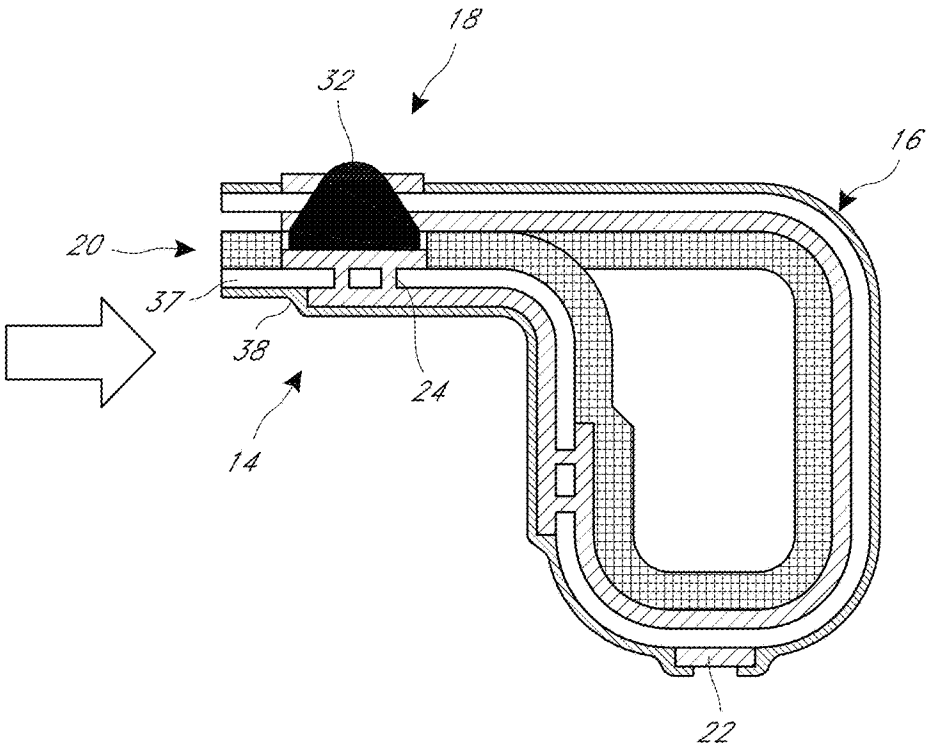
FIG. 8B shows the portion of the flexible substrate shown in FIG. 8A after making an electrical connection between the tip or the end of a substrate segment and the base of the flexible substrate.
Figure 8A:
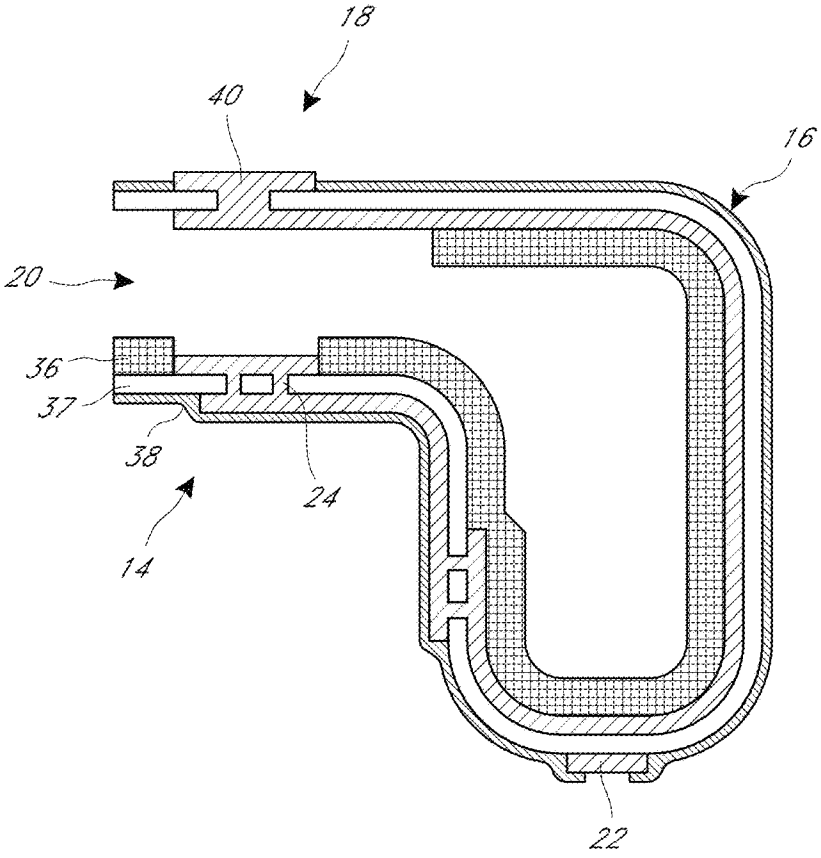
FIG. 8A is a cross sectional side view of a portion of the flexible substrate shown in FIG. 7.

FIG. 8A is a cross sectional side view of a portion of the substrate 12 taken along lines 8A-8A of FIG. 7. FIG. 8B shows the portion of the substrate 12 shown in FIG. 8A after making an electrical connection between the tip 18 one of the segments 16 and the base 14. As illustrated in FIGS. 8A and 8B, the adhesive layer 36 may be disposed on the base 14 and at an inner periphery of the segment 16. In some embodiments, the adhesive layer 36 that is disposed at the inner periphery of the segment 16 may be adhered to the core 10 (see, for example, FIGS. 2 to 4A) such that the segment 16 stays in place at least during assembly. A skilled artisan would understand that such use of the adhesive layer 36 can be applied to any embodiments of the transformer 1 disclosed herein. At the contact portion 20, the edge contact 40 at the tip 18 and the corresponding conductive material 24 of the base 14 can be aligned and the tip 18 and the base 14 may be adhered by the adhesive layer 36. After wrapping the flexible substrate 12 about the core 10, the edge contact 40 of the tip 18 of the segment 16 can leave a portion of an electrical contact on the base 14 exposed. This allows visibility during the process of connecting the conductive material 24 and the edge contact 40, by way of, for example, soldering. The permanent adhesive 32 (e.g., solder) can electrically connect the edge contact 40 and the conductive material 24, as shown in FIG. 8B. The edge contact 40 allows the permanent adhesive 32 (e.g., solder) to be visible after making the electrical connection. This can be beneficial for, for example, inspecting the connection.

Figure 8D:
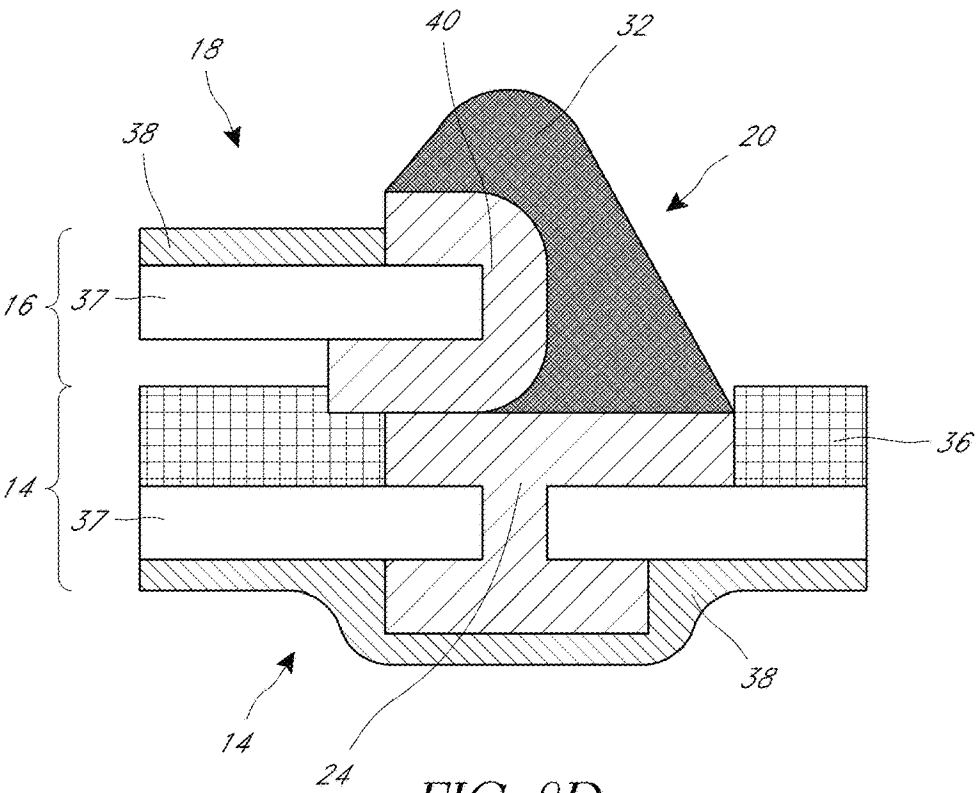
FIG. 8D shows a cross sectional side view of the contact portions shown in FIG. 8C after making the electrical connection between the tip and the base.
Figure 8C:
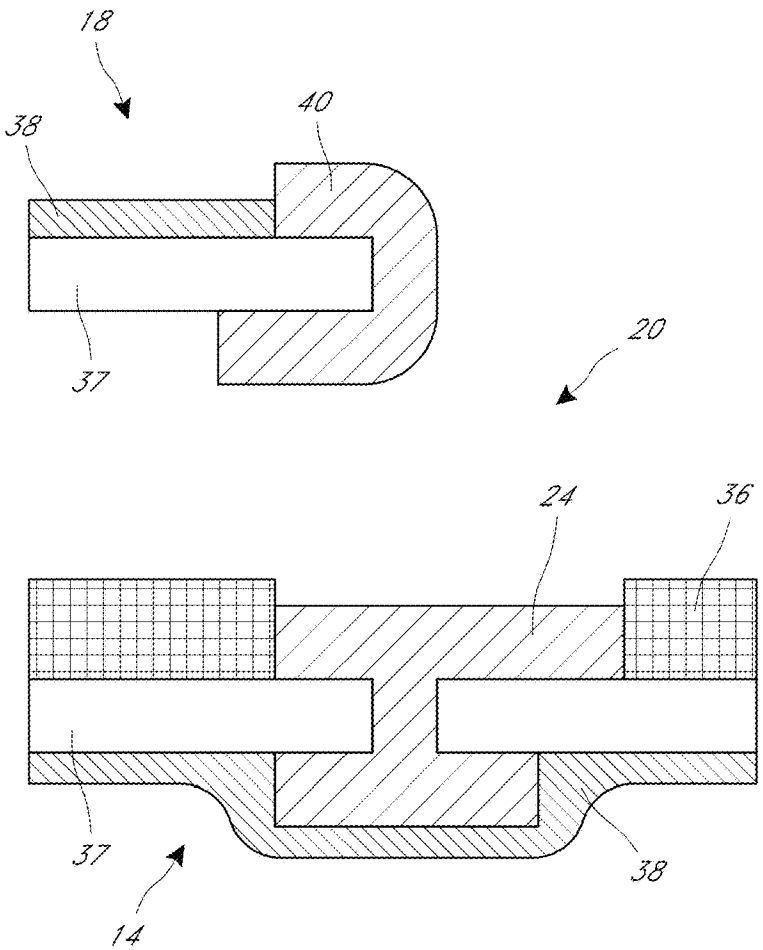
FIG. 8C is a cross sectional side view of contact portions of FIG. 7.

FIG. 8C is a cross sectional side view of the contact portions 20 of both the segments 16 and the base 14 of FIG. 7. FIG. 8D shows a cross sectional side view of the contact portions 20 shown in FIG. 8C after making the electrical connection between the tip 18 and the base 14. The edge contact 40 may comprise a copper plated sidewall of the nonconductive layer 37 (e.g., polyimide) to allow the solder connection to be visible after making the electrical connection is made in FIG. 8D.

Figure 9B:
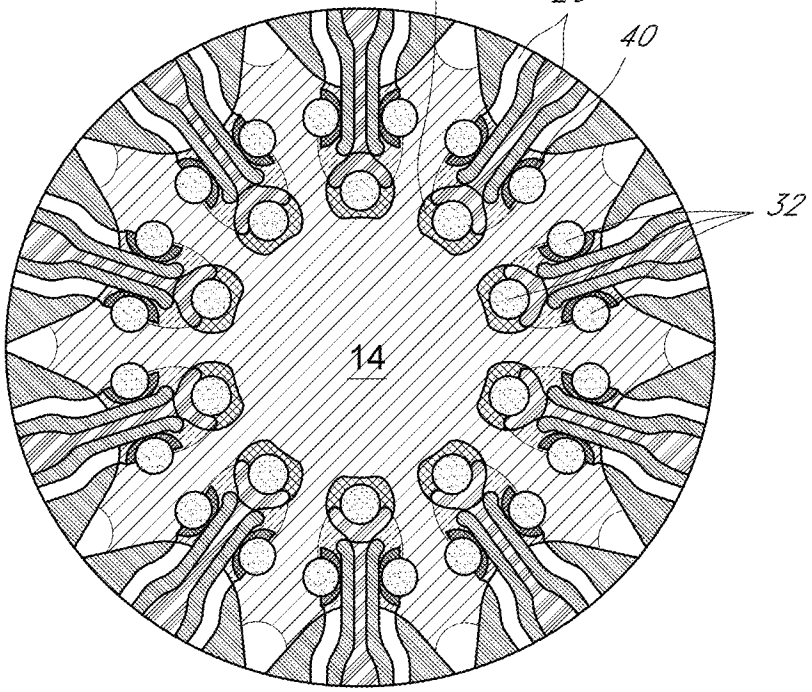
FIG. 9B is a schematic top view showing the segment tips and the base of the flexible substrate after soldering.
Figure 9A:
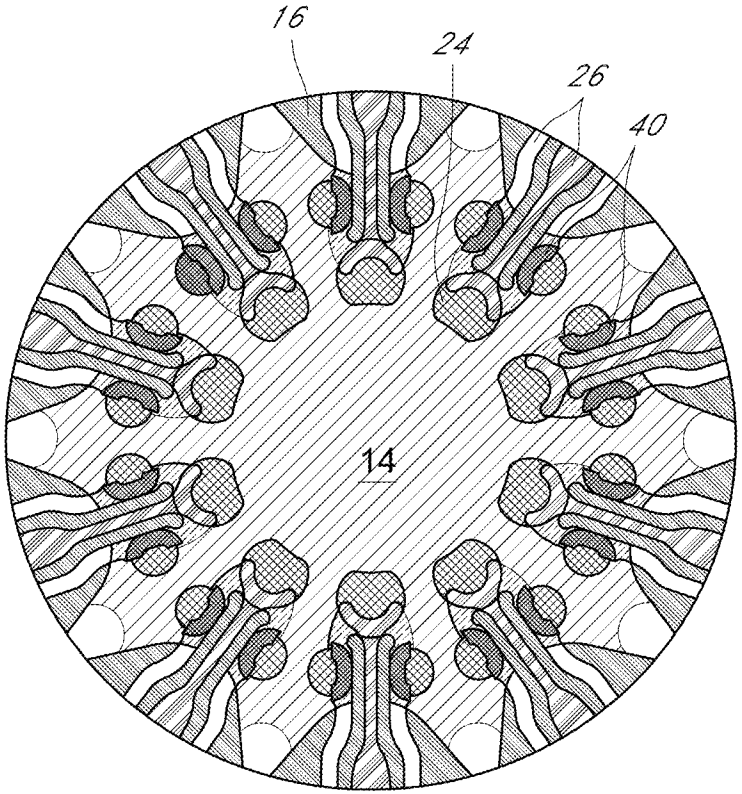
FIG. 9A is a schematic top view showing segment tips and the base of the flexible substrate before soldering in one embodiment.

FIG. 9A is a schematic top view showing the first and second portions, segments 16 and base 14, of the flexible substrate 12 aligned during assembly but before soldering in one embodiment. FIG. 9B is a schematic top view showing the segments 16 and base 14 of the flexible substrate 12 after adding permanent adhesive 32, e.g. by soldering, in the embodiment.

Figure 10A:
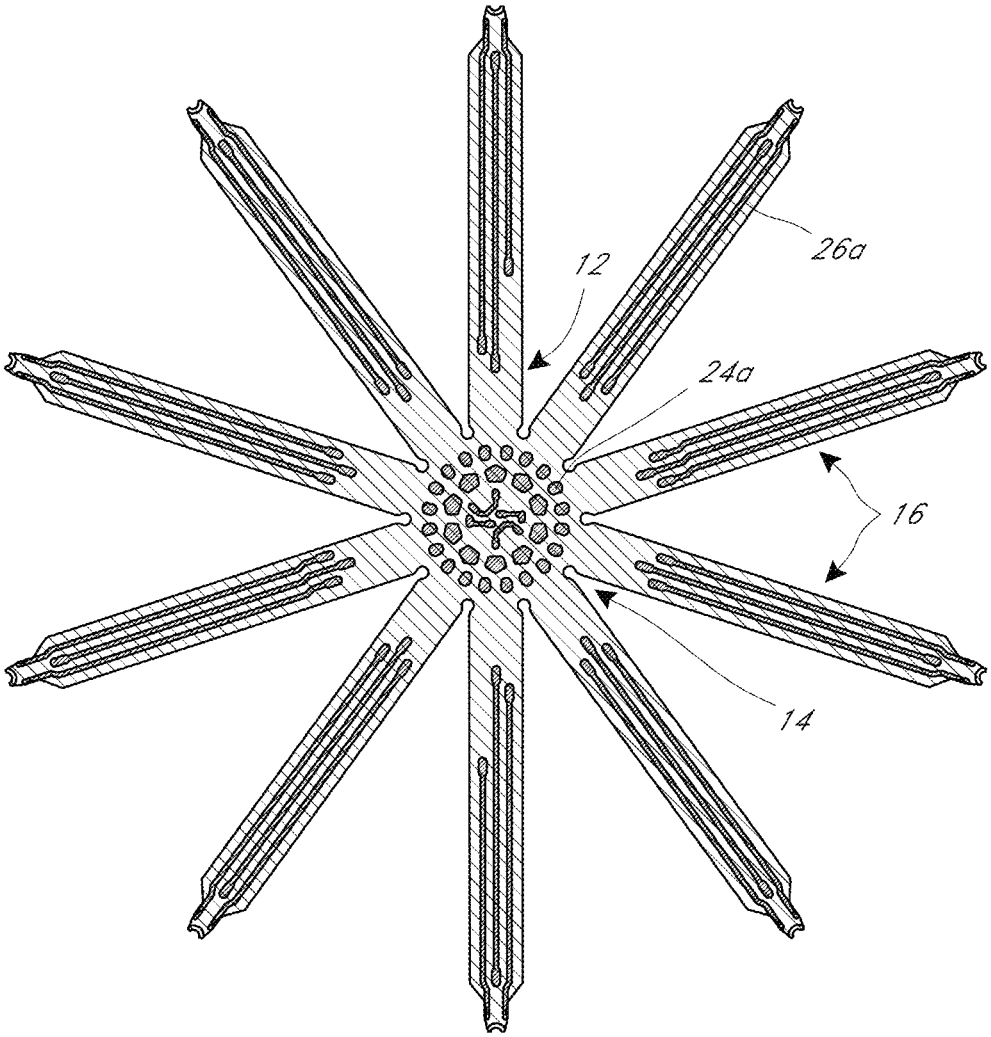
FIG. 10A is a plan view of a layer of conductive material within the flexible substrate in one embodiment.
Figure 10B:
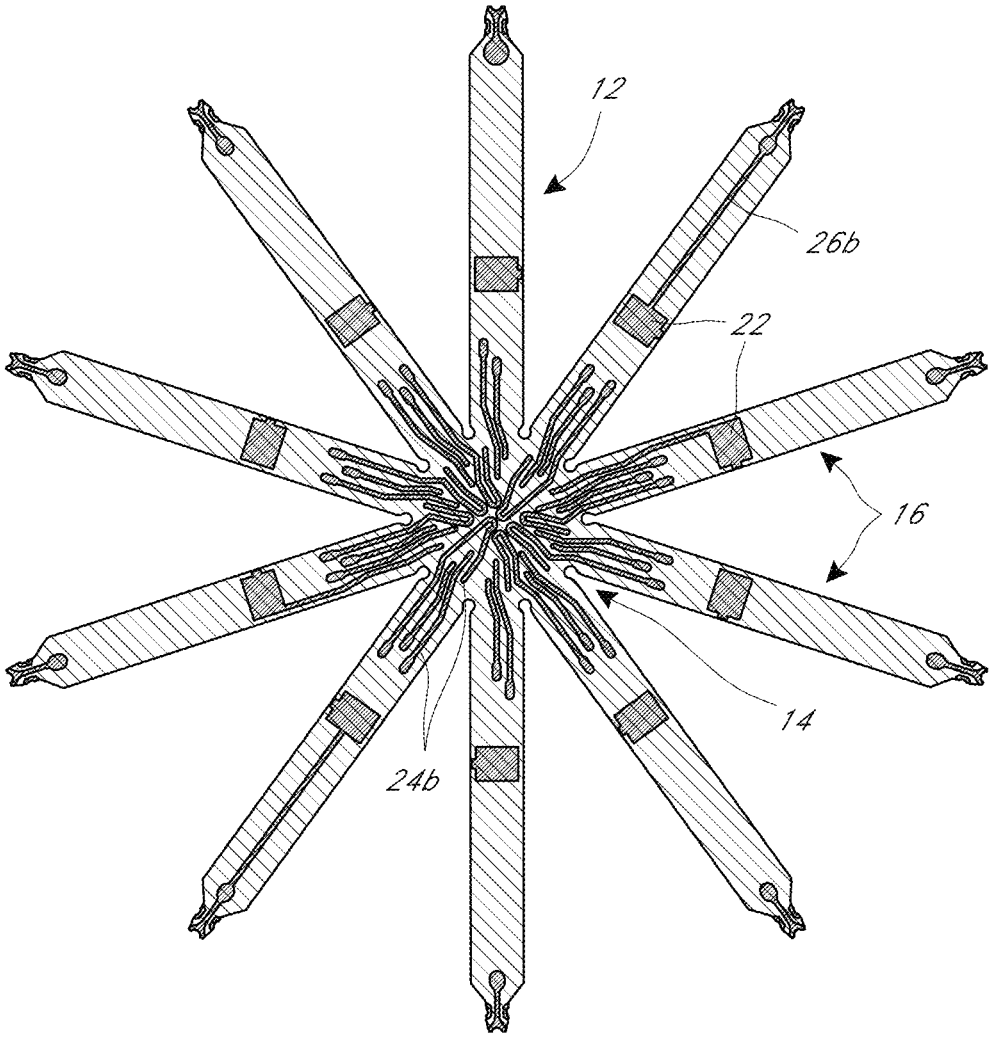
FIG. 10B is a plan view of another layer of conductive material within the flexible substrate in the embodiment.
Figure 10C:
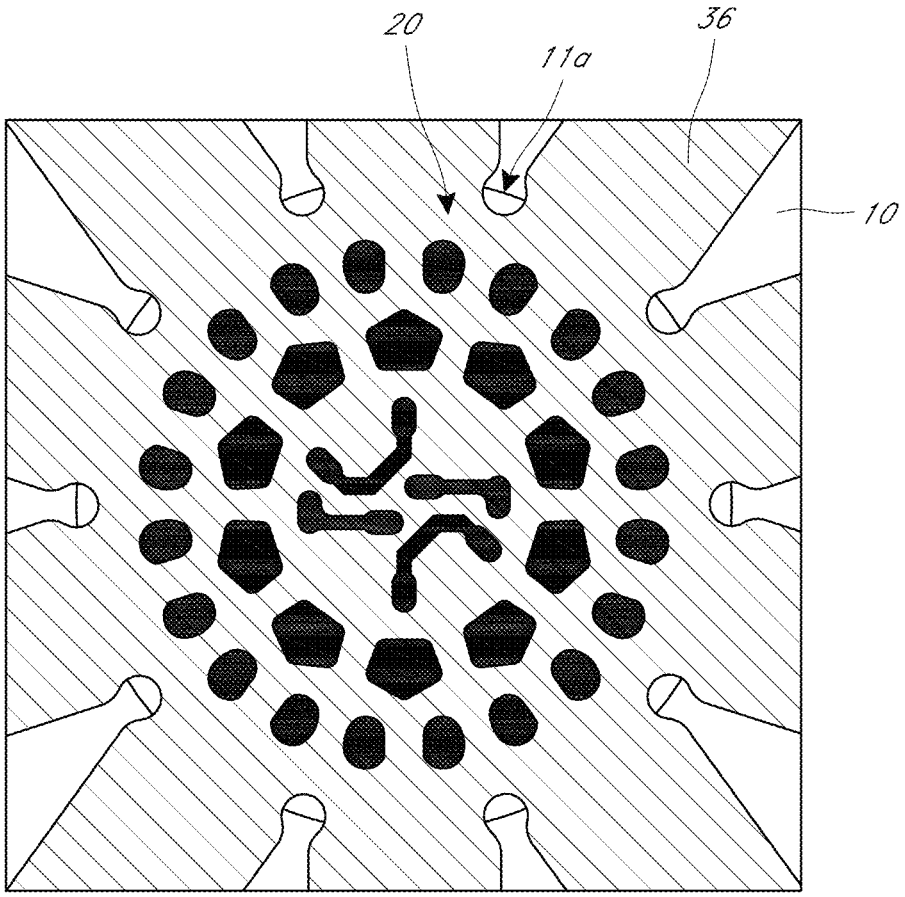
FIG. 10C shows a zoomed-in view of the contact portions of the layer of the substrate base shown in FIG. 10A.

FIGS. 10A and 10B show traces 24*a*, 24*b*, 26*a*, 26*b* in different layers of the flexible substrate 12 in one embodiment. In some embodiments, the layer shown in FIG. 10A can be embedded and the conductive layer (e.g., metal) formed by traces 24*b*, 26*b* shown in FIG. 10B can be an outer layer that faces away from the core 10 (see, for example, FIGS. 2 to 4A) when wrapped around the core 10. In some embodiments, the flexible substrate 12 may comprise any number of layers of traces as suitable. FIG. 10C shows a zoomed-in view of the contact portions 20 of the base 14, which are part of the conductive layer shown in FIG. 10A. FIG. 10C shows the contact portions 20 surrounded by the adhesive 36.

Figure 11B:
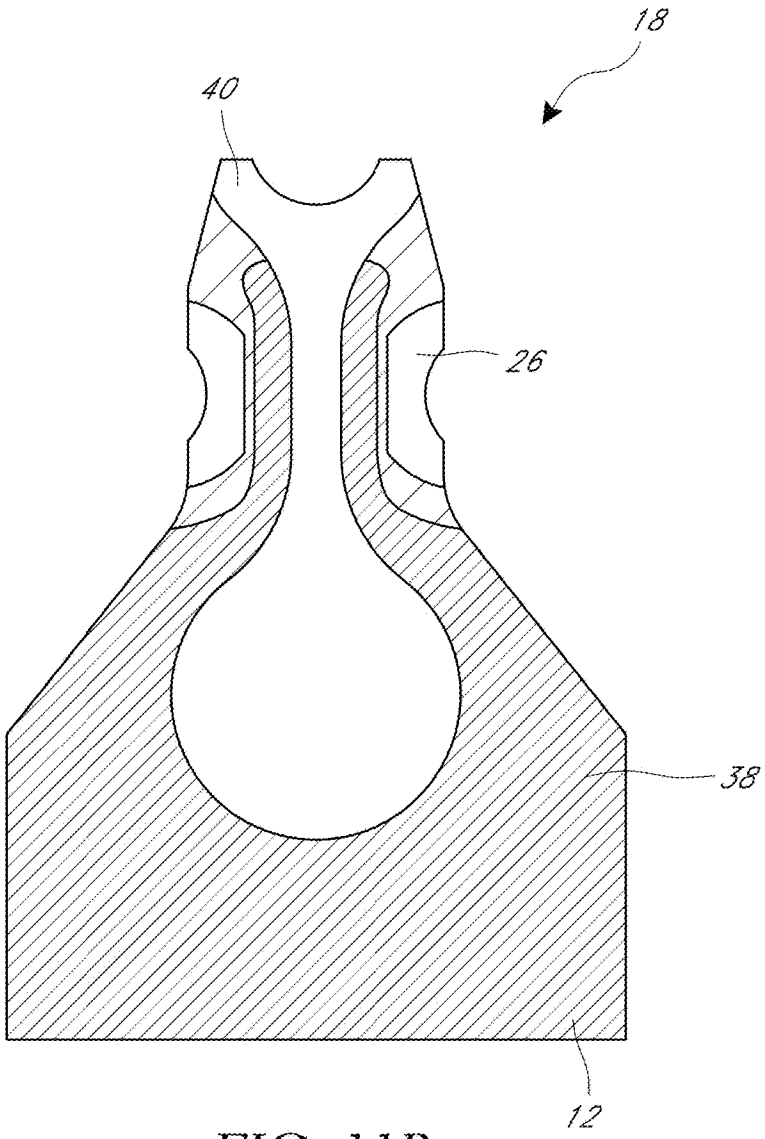
FIG. 11B shows another layer of the flexible substrate at the tip or the end of a substrate segment in the embodiment having edge contacts.
Figure 11A:
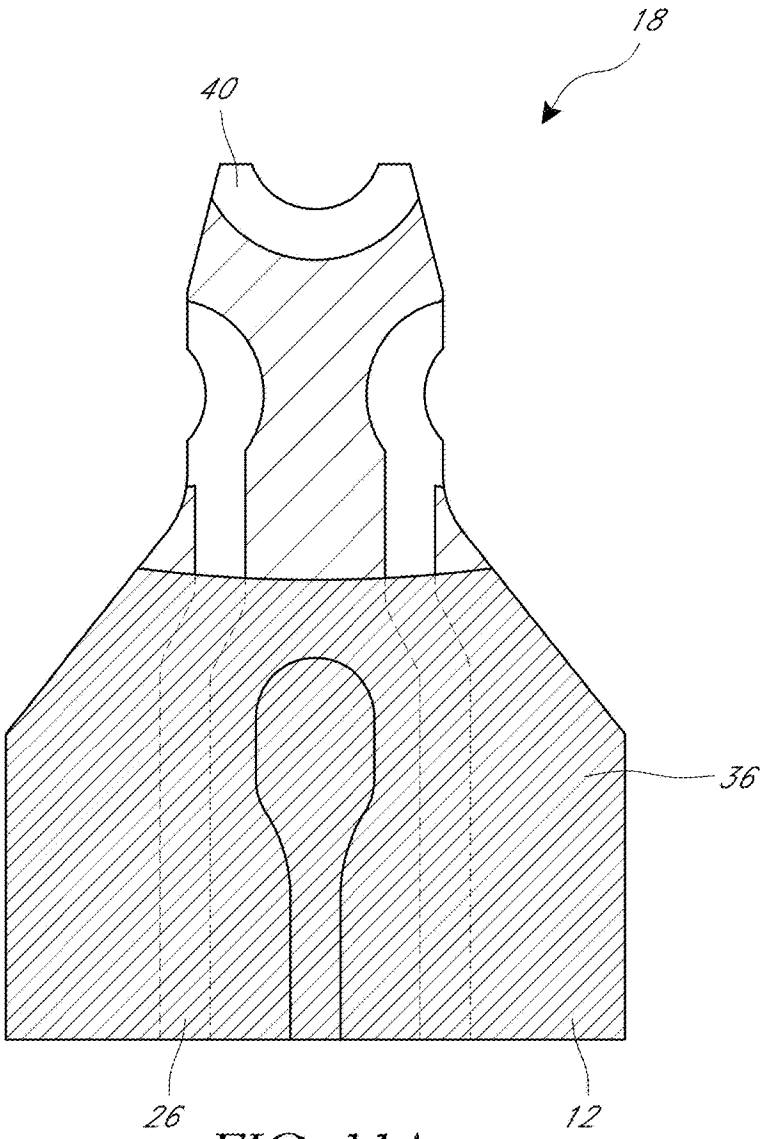
FIG. 11A shows a layer of the flexible substrate at the tip or the end of a substrate segment in one embodiment having edge contacts.

FIGS. 11A and 11B show different layers of the flexible substrate 12 at the tip 18 of one of the segments 16 of the flexible substrate 12, in one embodiment, having edge contacts 40. The layer shown in FIG. 11A includes an adhesive layer 36 and traces 26 embedded in the flexible substrate 12. The layer shown in FIG. 11B includes the solder mask 38. The traces 26 are disposed underneath the adhesive layer 36 and/or the solder mask 38.

Figure 12B:
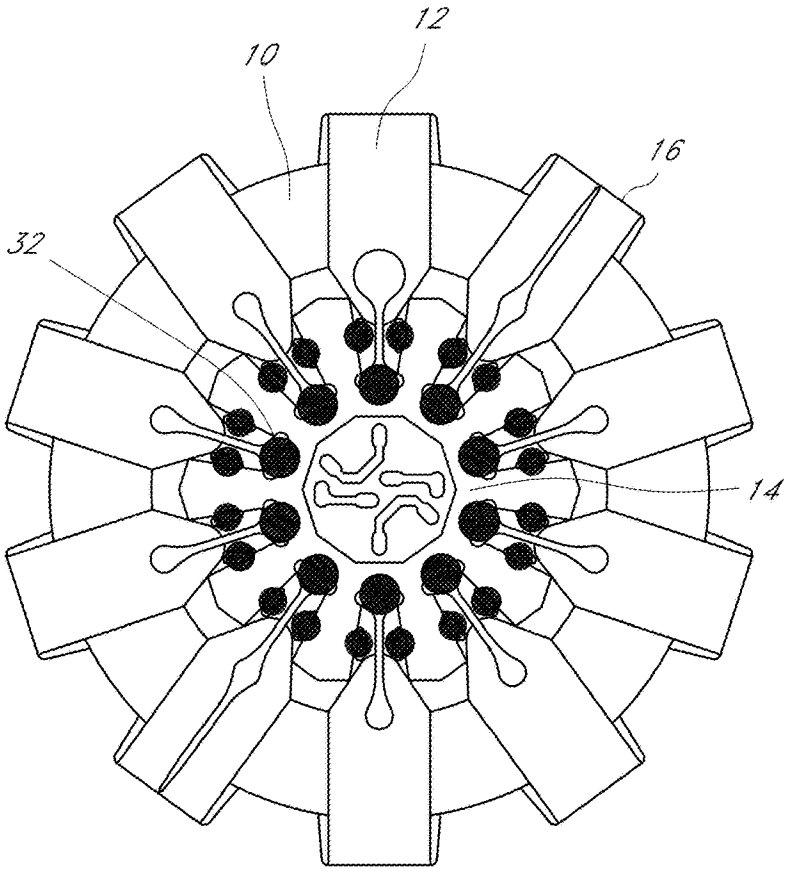
FIG. 12B is a schematic top view showing the segment and base portions of the flexible substrate after soldering in the embodiment.
Figure 12A:
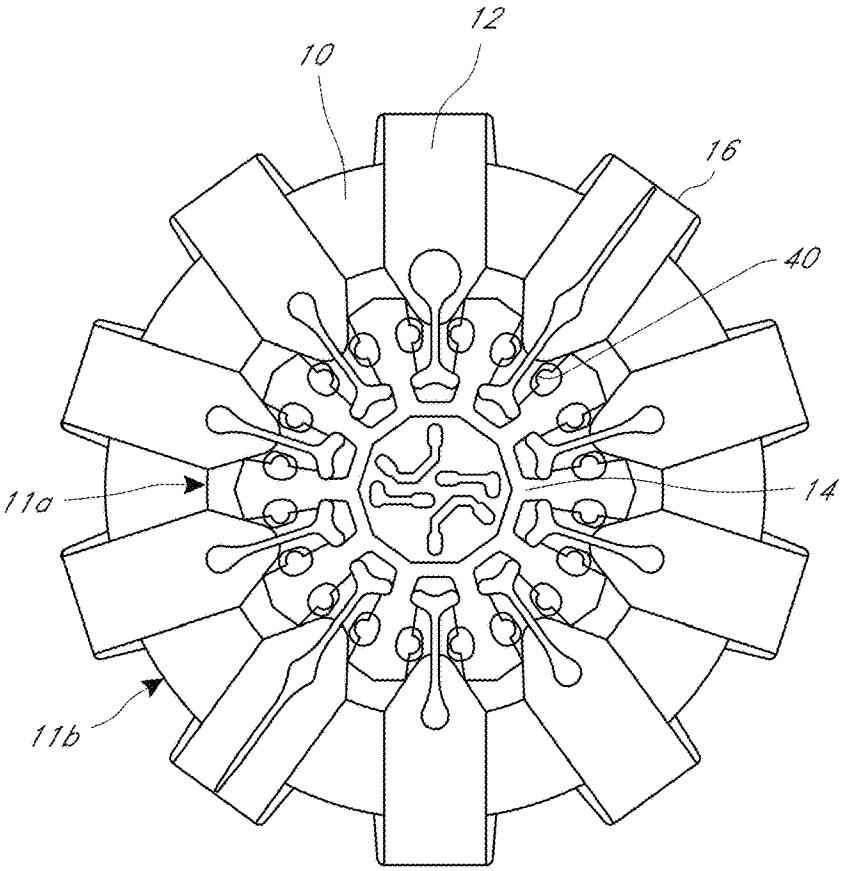
FIG. 12A is a schematic top view showing segment and base portions of the flexible substrate before soldering in one embodiment.

FIG. 12A is a schematic top view showing the first and second portions, the segments 16 and base 14, of the flexible substrate 12 before soldering in one embodiment. FIG. 12B is a schematic top view showing the segments 16 and base 14 of the flexible substrate 12 after soldering in the embodiment. The tips 18 of the segments 16 of the substrate 12 shown in FIGS. 12A and 12B comprise the edge contacts 40. As shown in FIG. 12B, after the soldering, the solder connection is visible, allowing visual inspection of the quality of the joints.

Figure 13:
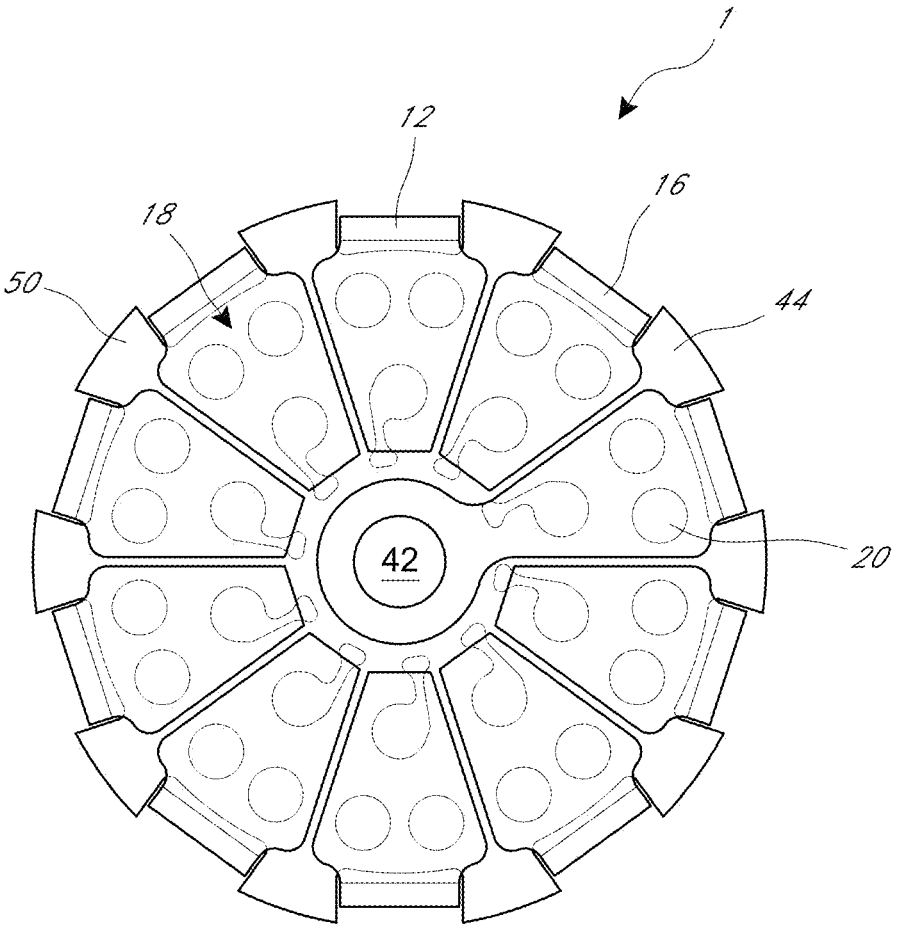
FIG. 13 is a schematic top view of a transformer in one embodiment including a redistribution substrate between the base of the flexible substrate and the segments of the flexible substrate.

FIG. 13 is a schematic top view of a transformer 1 in one embodiment including a redistribution substrate 44. The redistribution substrate 44 is electrically connected to an upper surface of the base (second) portion 14 of the flexible substrate 12. The segments 16 (first portions) of the flexible substrate 12 can extend vertically from the base 14 along an inner side of the annular (toroidal) magnetic core 10 (see, for example, FIGS. 15A and 15B) and wrap up and around the outside of the core 10. The redistribution substrate 44 may comprise a means for distributing the contact portions of the base 14 (second portion) of the substrate 12. The tips 18 of the segments 16 are electrically connected to a top side of the redistribution substrate 44. Contact portions 20 for making electrical connections between the segments 16 and the redistribution layer 44 are also shown. While, for example, the embodiment shown in FIG. 2 where the electrical connection portions 20 between the base 14 and the segment 16 are located within the opening inside the annular core 10 (e.g., within the inner periphery 11*a* of the magnetic core 10), the embodiment shown in FIG. 13 has the electrical connection portions 20 located more outwardly (e.g., between the inner periphery 11*a* and the outer periphery 11*b* of the magnetic core 10). Therefore, the distribution substrate 44 may make it easier for the tips 18 of the segments 16 to be aligned to the corresponding pads on the distribution substrate 44.

Figure 14B:
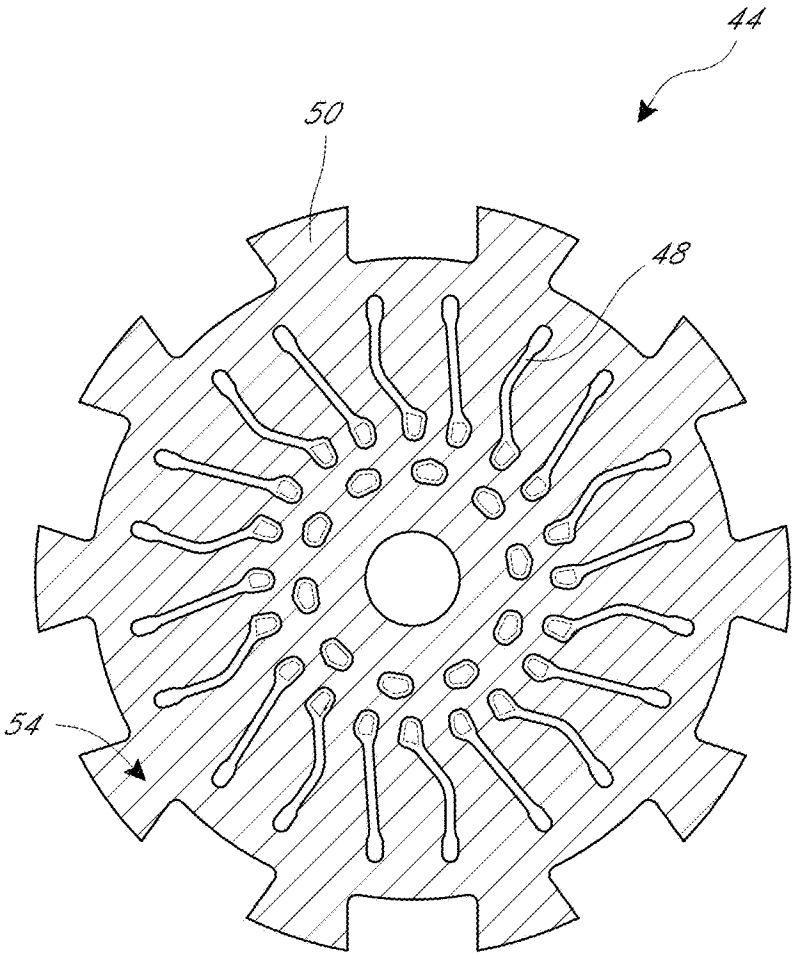
FIG. 14B shows bottom plan view of the redistribution substrate in one embodiment.
Figure 14A:
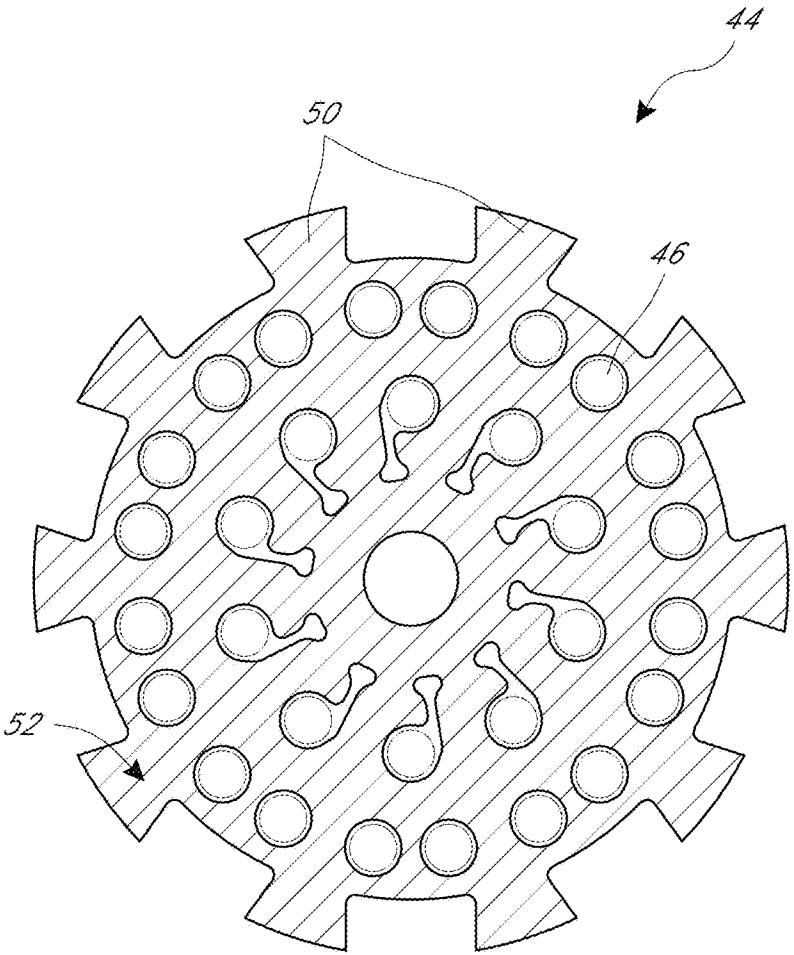
FIG. 14A shows top plan view of the redistribution substrate in one embodiment.

FIGS. 14A and 14B show top and bottom views, respectively, of the redistribution substrate 44 in one embodiment. Redistributed contacts 46 on a top side 52 are shown in FIG. 14A and electrical connections 48 on a bottom side 54 between the redistributed contacts 46 to the original contacts on the base 14 of the flexible substrate 12 are shown in FIG. 14B. As can be seen from FIG. 14B, the larger redistribution substrate 44 permits larger and more well-spaced contacts 46 on its top side, relative to the top side of the underlying base 14 of the flexible substrate 12. Locking features 50 can guide the flexible substrate during folding by receiving the width of the first portions or segments of the flexible substrate. In some embodiments, as explained in more detail below, the redistribution substrate 44 may include a recess and/or protrusion (similar to those explained in, for example, FIGS. 5A-5C) to accurately align the redistribution substrate 44 relative to the substrate 12. The larger bonding pad can eliminate an accumulated positional tolerance during folding of the segments. In some embodiments, the redistribution substrate 44 can enlarge the contact portions 46 relative to the contact pads on the underlying base 14 by more than 100%. In some embodiments, as shown herein, the locking features 50 of the redistribution substrate 44 can comprise teeth.

Figure 15B:
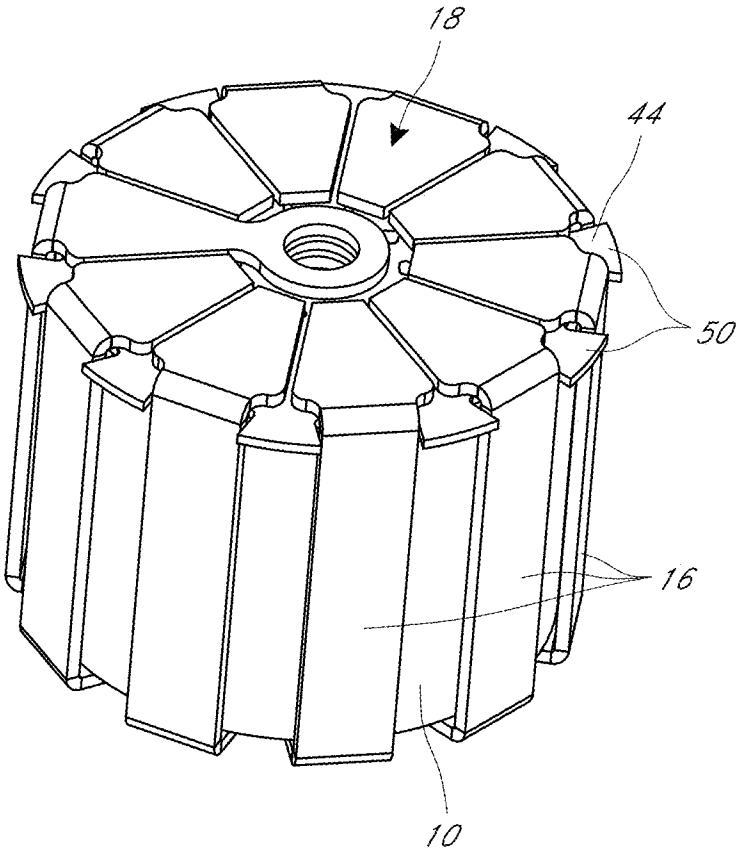
FIG. 15B is a schematic isometric view from the top (flex-to-flex bond) side of the transformer in that includes the redistribution substrate between the base of the flexible substrate and the segments of the flexible substrate.
Figure 15A:
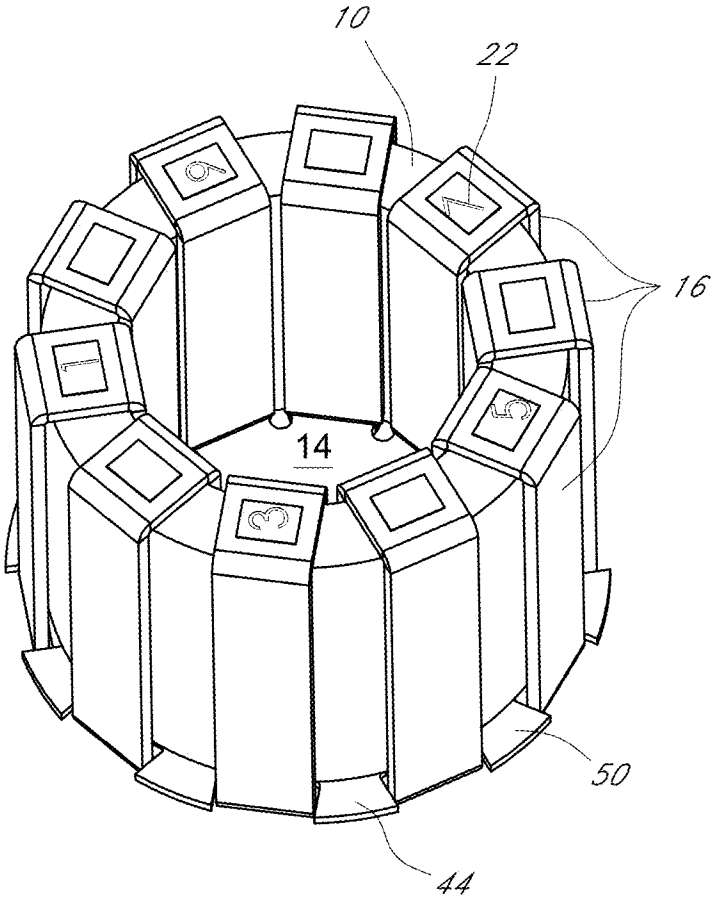
FIG. 15A is a schematic isometric view from the bottom (solder pad) side of a transformer in one embodiment that includes the redistribution substrate between the base of the flexible substrate and the segments of the flexible substrate.

FIGS. 15A and 15B are schematic isometric views of a transformer 1 in one embodiment that includes the redistribution substrate 44 between the base 14 and the segments 16 of the flexible substrate 12. The locking features 50 (e.g., teeth) of the distribution substrate 44 can be disposed between the segments 16 of the substrate 12, which may, in some embodiments, provide better alignment between connections of the tips 18 of the substrate 12 and the redistribution substrate 44. A skilled artisan will appreciate that the tips 18 of the segments 16 illustrated in FIG. 15B may comprise the edge contacts 40 illustrated, for example, in FIGS. 11A and 11B.

Figure 16:
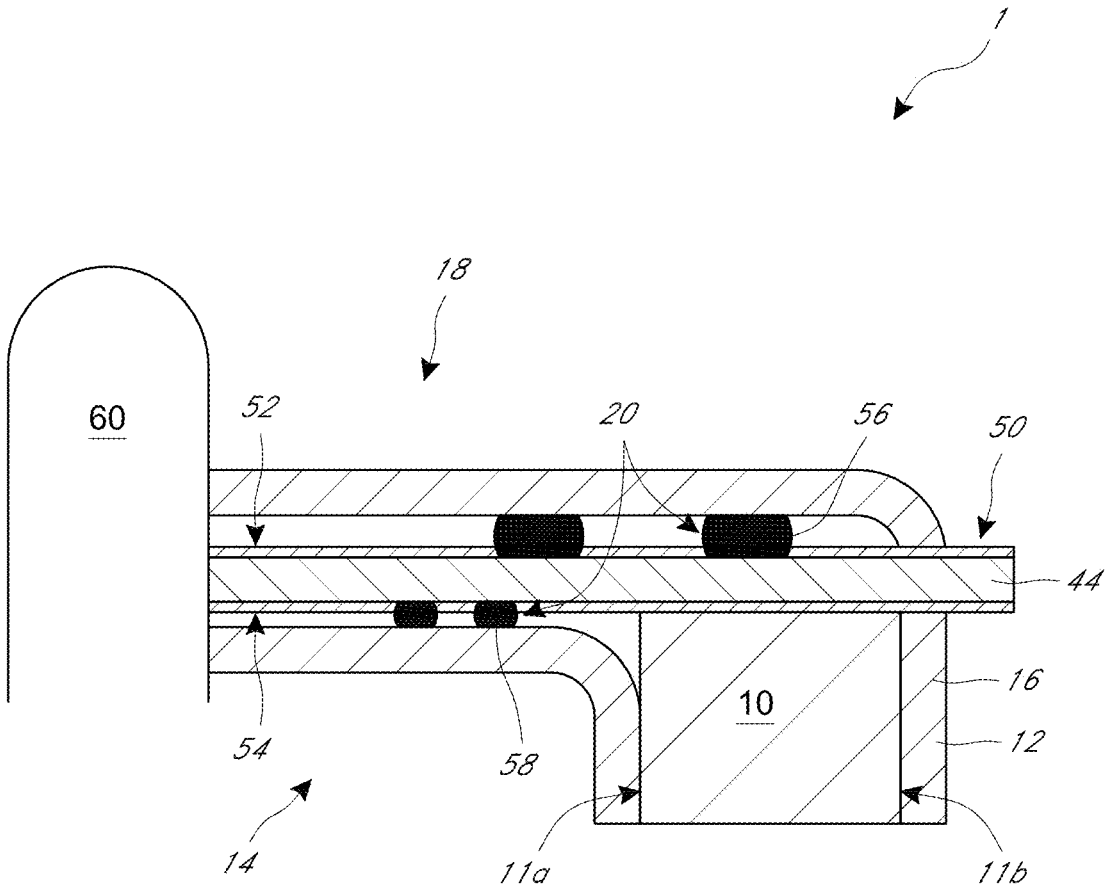
FIG. 16 shows a schematic cross sectional side view of a transformer near the connection portions in one embodiment.

FIG. 16 shows a schematic cross sectional view of a transformer 1 near the connection portions 20 in one embodiment. A redistribution substrate 44 (RD flex) is disposed between the tips 18 and the base 14 of the flexible substrate 12. The redistribution substrate 44 redistributes solder joints 58 on the bottom side 54 of the redistribution substrate 44 to solder joints 56 on the top side 52 of the redistribution substrate 44. The redistributed solder joints 56 can be electrically connected to the tip 18 of one of the segments 16 the substrate 12. The embodiment shown in FIG. 16 includes a guide pin 60 that can mechanically lock the position of the tips 18 of the substrate 12 relative to the redistribution substrate 44 by receiving a through hole 62 (see, for example, FIG. 17) near the tip 18 of the segment 16, such that the positions of the flex base 14, the redistribution substrate 44 and the flex segments 16 can be relatively fixed during bonding. The guide pin 60 can mechanically lock the position of the segment 16 temporarily and after the bonding (e.g., soldering), the pin 60 may be removed. The guide pin 60 can be removed by, for example, pushing one end of the guide pin 60 and/or pulling the guide pin 60 from another end. The redistribution substrate 44 shown in FIG. 16 also includes the locking features 50 (e.g., teeth) which may guide the segments 16 during wrapping or folding of the segments 16 around the core 10. This embodiment can also or alternatively include an adhesive layer between the segment 16 and the redistribution substrate 44, and/or protrusion and recess as described with, for example, FIGS. 5A and 5B above. Alternatively, the locking features 50 and/or 60 can obviate the temporary adhesive, and/or protrusion and recess between the contacts at the segment tips 18 and the redistribution substrate 44, for guiding, aligning and/or holding the segments to the base prior to permanent bonding.

In some embodiments, the redistribution substrate 44 may comprise a mechanical interlock feature similar to that explained above with respect, for example, FIGS. 5A and 5B. For example, the top side 52 of the redistribution substrate 44 may comprise recesses that can receive protrusions formed at the tips 18 of the flexible substrate 12. Additionally, the bottom side 54 of the redistribution substrate 44 may comprise protrusions that can be disposed into corresponding recesses formed on the base 14 of the substrate. Of course, in other embodiments, the top side 52 of the redistribution substrate 44 may comprise the protrusions, the bottom side 54 of the redistribution substrate 44 may comprise the recesses, both the top and bottom sides 52, 54 of the redistribution substrate 44 may comprise the recesses, or both the top and bottom sides 52, 54 of the redistribution substrate 44 may comprise the protrusions.

Figure 17A:
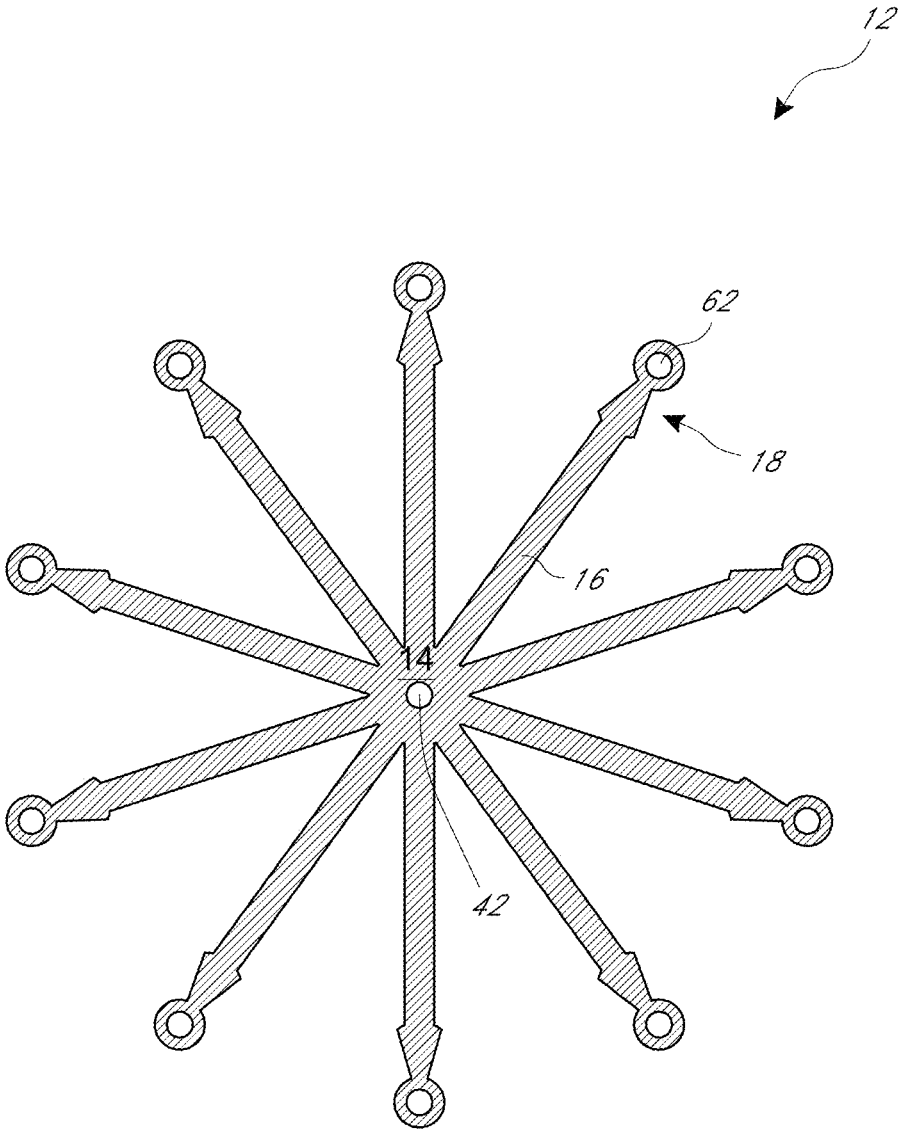
FIG. 17A is a top plan view of a flexible substrate that includes through holes in an unfolded state.
Figure 17B:
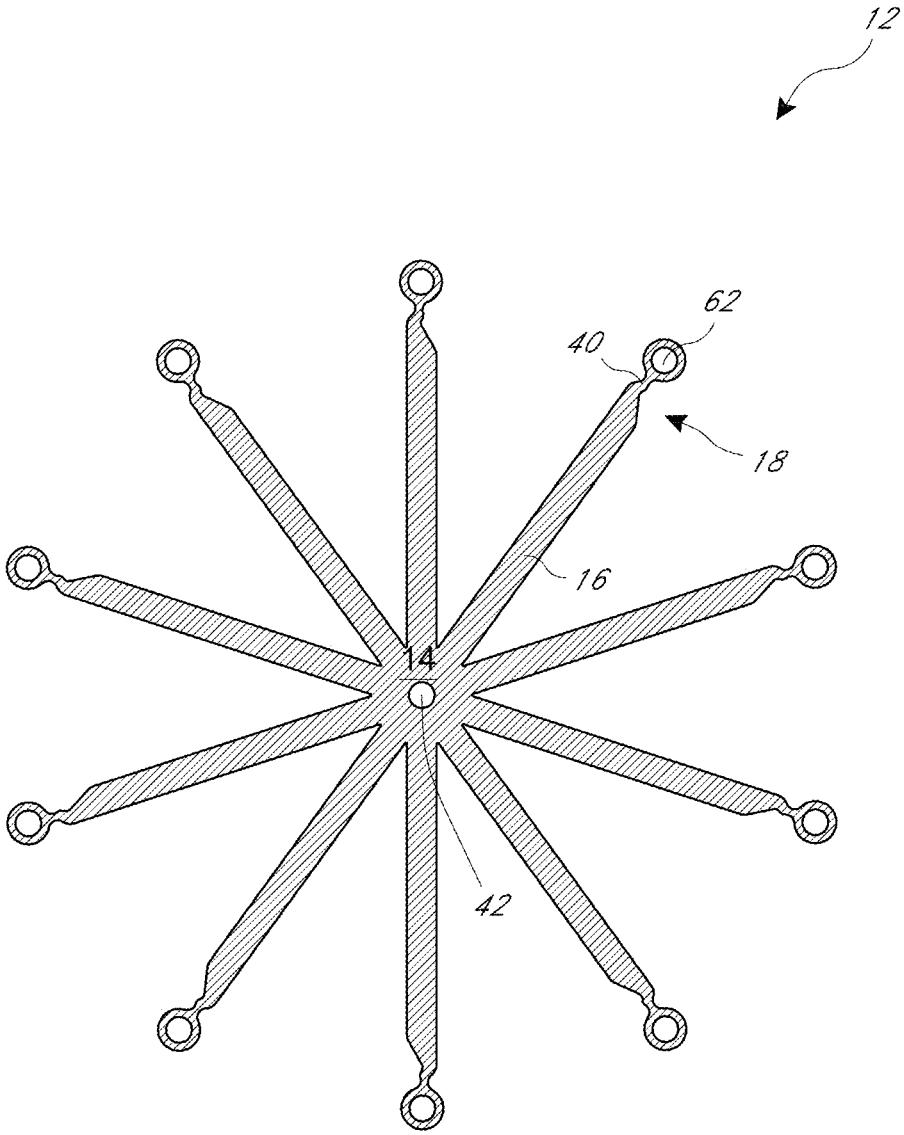
FIG. 17B is a top plan view of an alternate flexible substrate that includes through holes and edge contacts in an unfolded state.

FIG. 17A shows a flexible substrate 12 that includes through holes 62 in an unfolded state (before wrapping about an annular magnetic core). FIG. 17B shows a flexible substrate 12 that includes through holes 62 and edge contacts 40 in an unfolded state (before wrapping about an annular magnetic core). The hole 42 in the base 14 and the through holes 62 at the tips 18 are configured to receive the guide pin 60 as illustrated in, for example, FIG. 16.

Figure 18B:
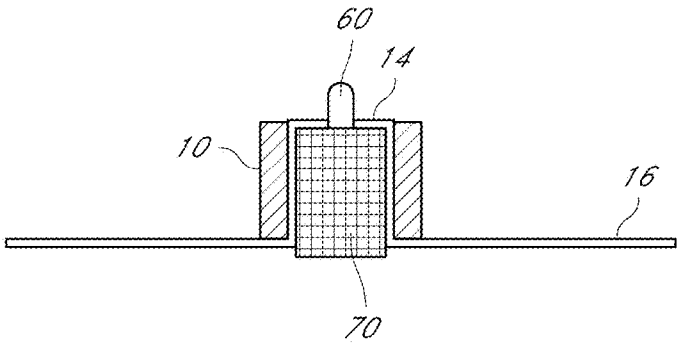
FIG. 18B is a schematic side cross section and corresponding top plan view showing another stage of the process after FIG. 18A.
Figure 18B:
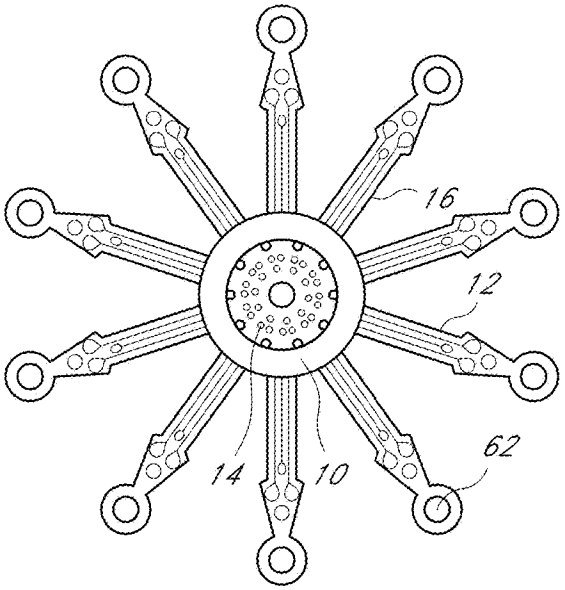
Figure 18A:
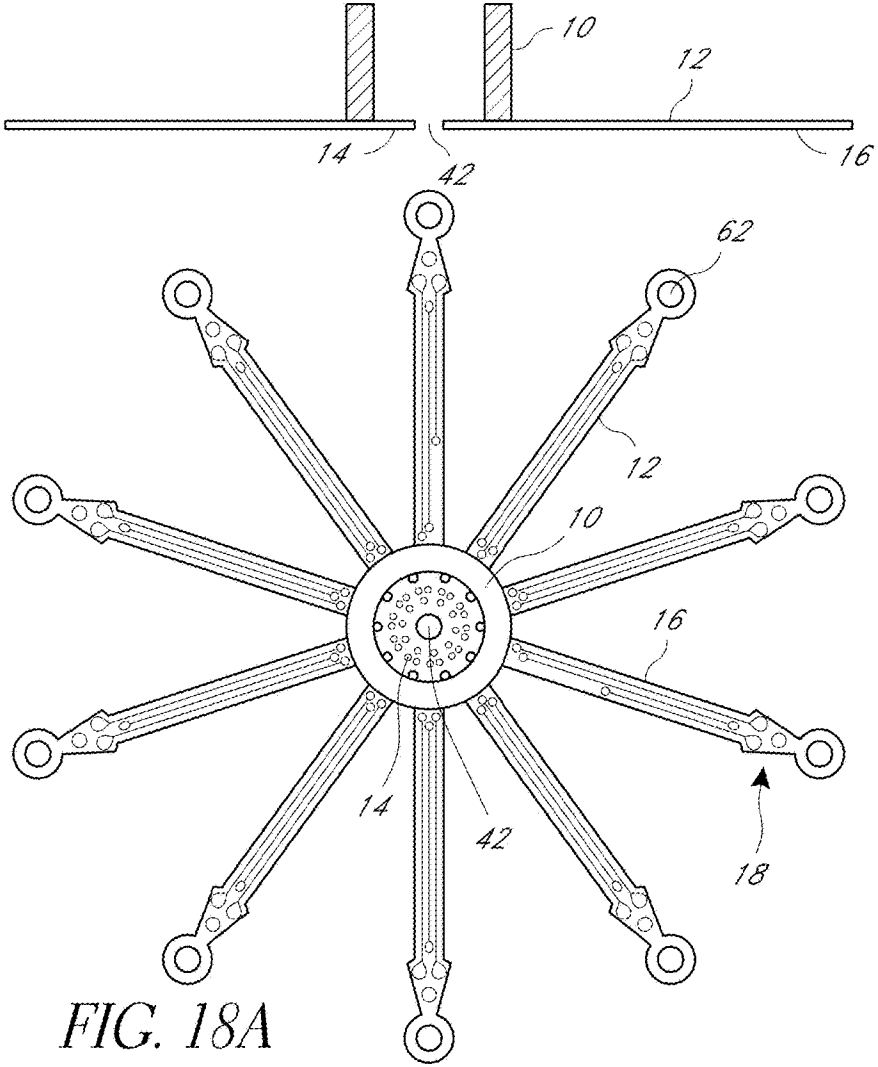
FIG. 18A is a schematic side cross section and corresponding top plan view showing a stage of a process how the substrate wraps a magnetic core in one embodiment to form a transformer.
Figure 18E:
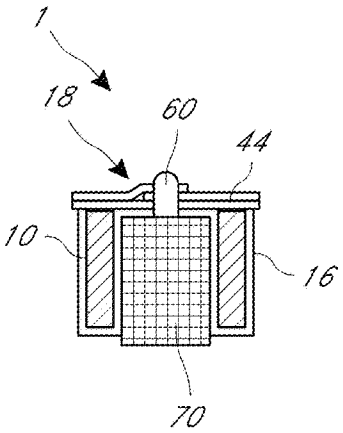
FIG. 18E is a schematic side cross section and corresponding top plan view showing another stage of the process after FIG. 18D.
Figure 18E:
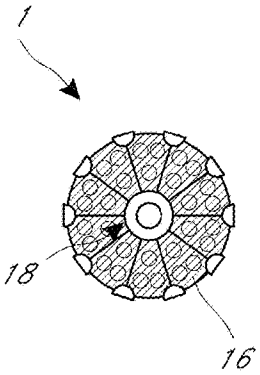
Figure 18D:
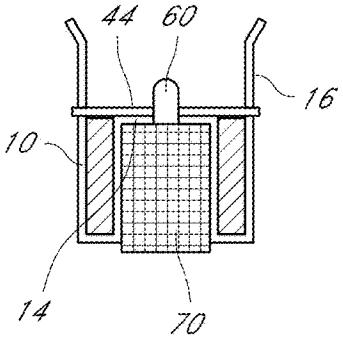
FIG. 18D is a schematic side cross section and corresponding top plan view showing another stage of the process after FIG. 18C.
Figure 18D:
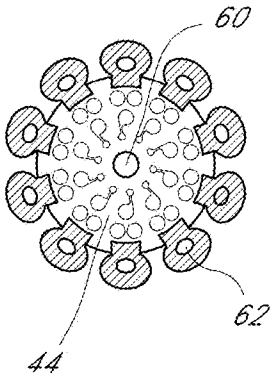
Figure 18C:
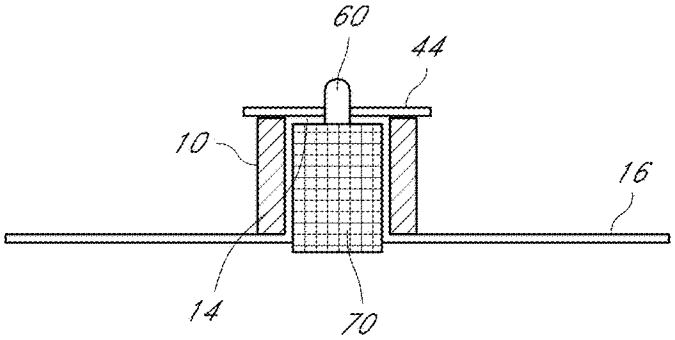
FIG. 18C is a schematic side cross section and corresponding top plan view showing another stage of the process after FIG. 18B.
Figure 18C:
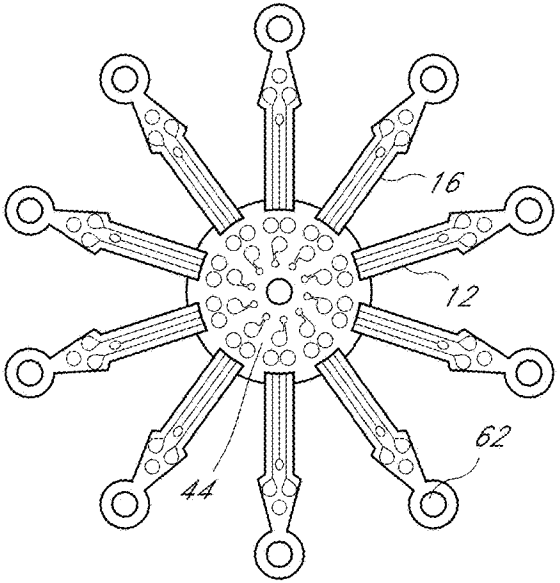

FIGS. 18A to 18E show a sequence for wrapping the flexible substrate 12 about a magnetic core 10 in one embodiment to form a transformer 1. The sequence flows from FIG. 18A to FIG. 18E. The top half portions of FIGS. 18A to 18E show schematic cross sectional views and the bottom half portions of FIGS. 18A to 18E show schematic plan views. This embodiment includes a guide pin 60, through holes 62 at the tips of segments 16, and a redistribution flex 44. FIG. 18A shows the core 10 over a flat flexible substrate 12 before assembly. As shown in FIG. 18B, the sequence of assembly includes placing the guide pin 60 through the central hole 42 in the base 14, and folding the segments 16 over the pin base 70 from which the guide pin 60 protrudes. The pin base 70 can then be inserted into opening of the core 10, resulting in flex segments 16 from the base 14 extending through the opening of an annular magnetic core 10. As shown in FIG. 18C, the redistribution substrate 44 is placed over the guide pin 60 and the base 14. As shown in FIG. 18D, the segments 16 of the flexible substrate are then folded around the outer surface of the annular magnetic core 10. As shown in FIG. 18E, the tips 18 of the segments are then folded over the upper surface of the redistribution substrate 44, after which contact pads of the flex segments 16 can connect to contact pads of the redistribution substrate 44, which in turn connects to the base 14 of the flexible substrate 12. The conductors of the redistribution substrate 44 and the base 14 of the flexible substrate 12 interconnect the conductors of the segments 16 in a manner that defines windings around the magnetic core 10. The windings can have interleaved or interlaced/intertwined configurations as described above. The through holes 62 on the flex segments 16 and guide pin 60 extending through the flex base 14 and/or redistribution substrate 44 facilitate alignment of the contact pads on the tips 18 of the flex segments 16 with contact pads on the flex base 14 and/or redistribution substrate 44.

In some embodiments, as indicated in the assembly sequence shown above, the guide pin 60 can be formed on the pin base 70 that has a shape generally defined by an inner periphery of the magnetic core 10. Accordingly, the pin base 70 self-aligns the position of the guide pin 60 for assembly prior to bonding. In such embodiments, removal of the guide pin 60 can be achieved by pushing on the guide pin 60 after bonding to separate the transformer 1 from the guide pin 60 and the pin base 70. In some embodiments, the guide pin 60 can be removed after the contact pads of the flex segments 16 are connected to contact pads of the redistribution substrate 44. In some embodiments, in FIG. 18B, prior to attaching the redistribution substrate 44 in FIG. 18C, solder flux may be applied to the base 14. In some embodiments, in FIG. 18D, prior to attaching the tips 18 to the redistribution substrate 44 in FIG. 18E, solder flux may be applied to the redistribution substrate 44. In some embodiments, in FIG. 18E, heat (e.g., hot air) may be applied to the transformer 1 to reflow in order to connect the base 14 to the redistribution substrate 44 and/or the tips 18 to the redistribution substrate 44. In some embodiments a solder iron may be used to make solder connections between the base 14 and the redistribution substrate 44 and/or between the tips 18 and the redistribution substrate 44. In some embodiments the pin base 70 may be heated to provide the heat to connect the base 14 to the redistribution substrate 44 and/or the tips 18 to the redistribution substrate 44.

The sequence can apply to other embodiments described herein, even those without the guide pin 60, through hole 42, through holes 62 or redistribution substrate 44 (which may include locking features 50 to guide the segments 16). In embodiments without the redistribution substrate 44, flex segments 16 or fingers can attach directly to the flex base 14. In some embodiments, the sequence can apply to embodiments that includes any one or more of the interlock features and/or temporary adhesion layers disclosed herein. Such features can serve as means to guide alignment and/or temporarily hold the segments 16 in relation to the contacts of the base 14 (directly or indirectly through the redistribution substrate) before secure bonding, such as through soldering.

Figure 18F:
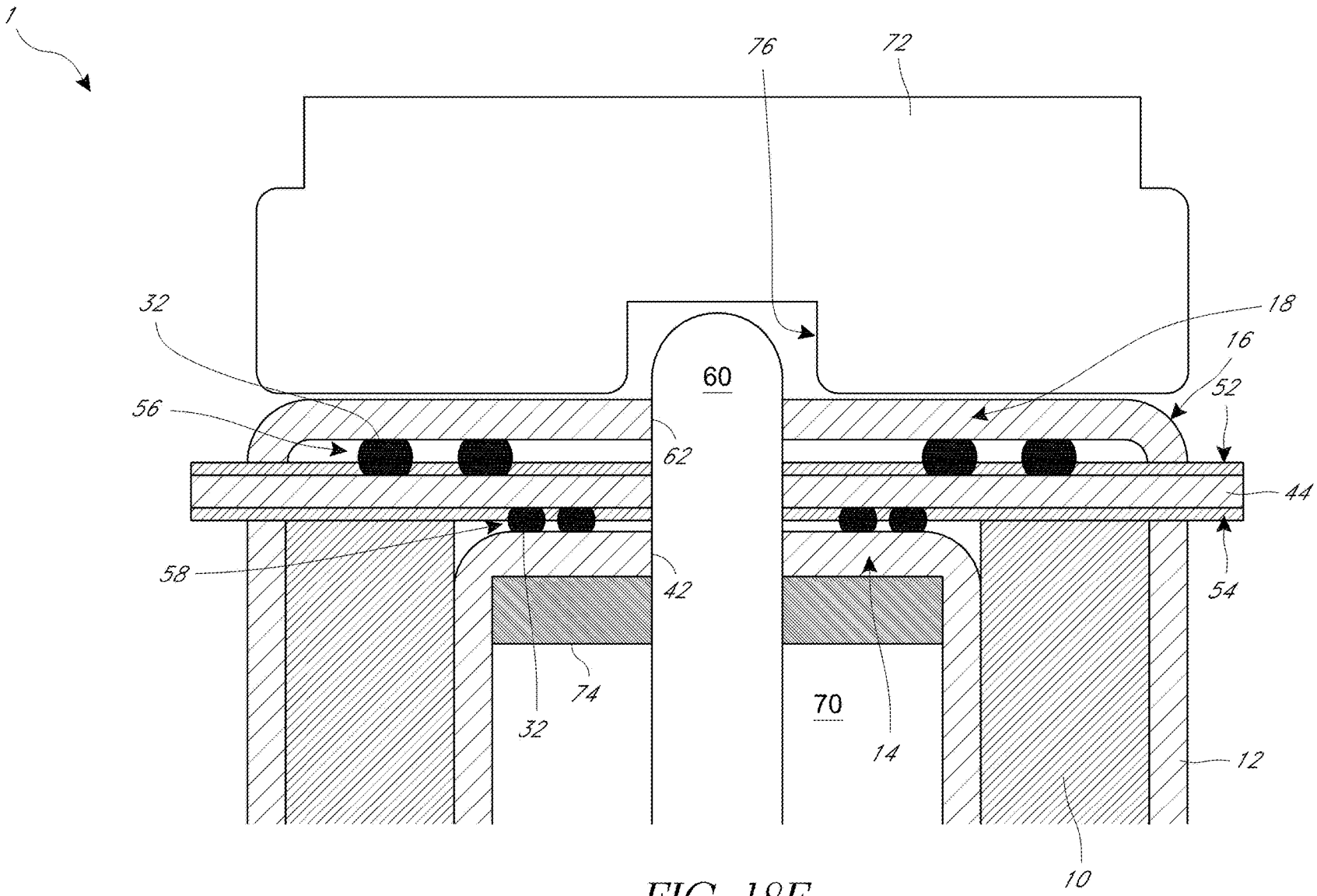
FIG. 18F is a schematic cross sectional side view of the transformer of FIG. 18E during a soldering process after assembly/alignment of the tips of the segments for electrical connection to the base.

FIG. 18F is a cross sectional side view of the transformer 1 after assembly/alignment of the tips 18 of the segments for electrical connection to the base 14, shown during a soldering process. In FIG. 18F a solder iron 72 is used to apply heat to the solder joints 56, 58. As illustrated in FIG. 18F, the solder iron 72 may be shaped to receive the pin 60 to effectively provide heat to the solder joints 56, 58. In some embodiments, an isolation layer 74 (e.g., polyimide fixture)

may be disposed underneath the base 14. The isolation layer 74 can isolate the base 14 of the substrate 12 and the pin base 70 to, for example, reduce heat loss to the pin base 70 and/or provide flatness to the base 14. In some embodiments, the solder iron 72 may cover portions of the sides of the transformer 1, which may provide, for example, easier alignment and/or better heat application than that covers only the top surface of the transformer 1. In some embodiments, the pin base 70 may provide heat to the solder joints 56, 58. In some embodiments, the solder iron 72 can apply pressure to the solder joints 56, 58 from the top surface of the transformer 1. A skilled artisan would understand that the shape of the solder iron 72 can be altered to be suitable for applying heat to solder joints in the transformer 1 having different shapes. For example, as seen in FIG. 18F, the solder iron 62 is shaped such that the top surface of the transformer 1 can be contacted while the solder iron 62 comprises a recess 76 to receive the guide pin 62.

Although FIG. 18F only shows the tips 18 of two segments 16, and does not show the overlap of multiple segments at the guide pin 60, consistent with FIGS. 13 and 15B, the skilled artisan will appreciate that, in other embodiments (see FIGS. 17A-18E), multiple segments 16 can overlap in the central region of the base 14 in embodiments that employ the through holes 62 engaging with the guide pin 60 for alignment/temporary fixation during soldering. Accordingly, for such embodiments, the guide pin 60 can be selected to have a height to accommodate the thicknesses of multiple segments 16, and the dimensions of the recess 76 in the solder iron 72 are similarly selected to accommodate the height of the guide pin 60.

Figure 19A:
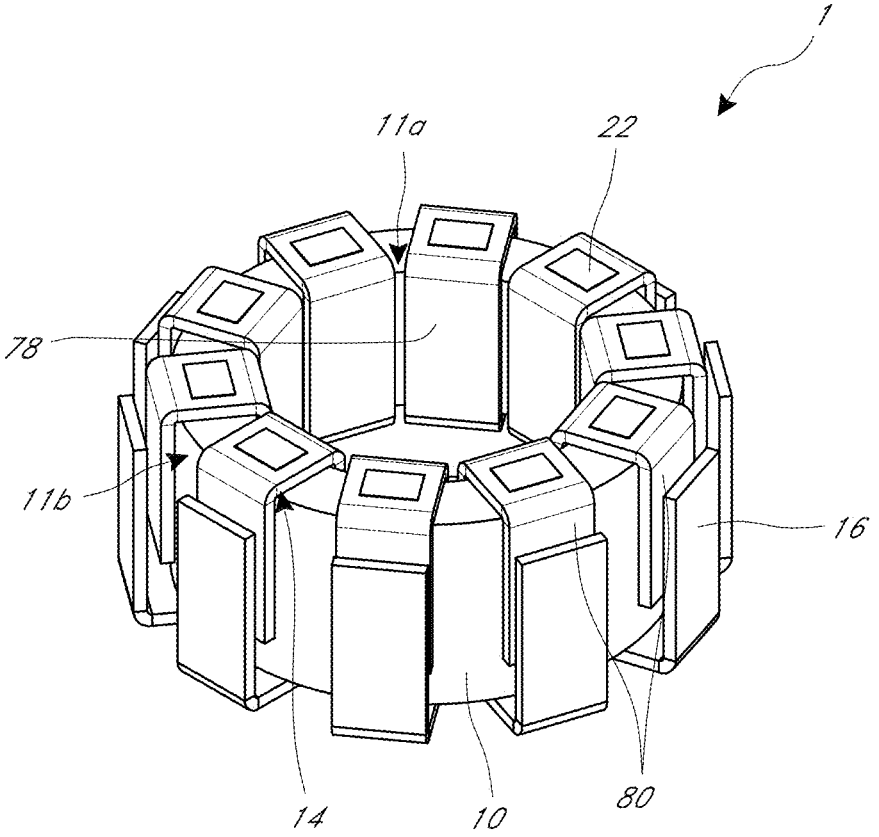
FIG. 19A shows an assembled electrical coil structure in one embodiment, where the base of the substrate runs along the inner surface of the core.
Figure 19B:
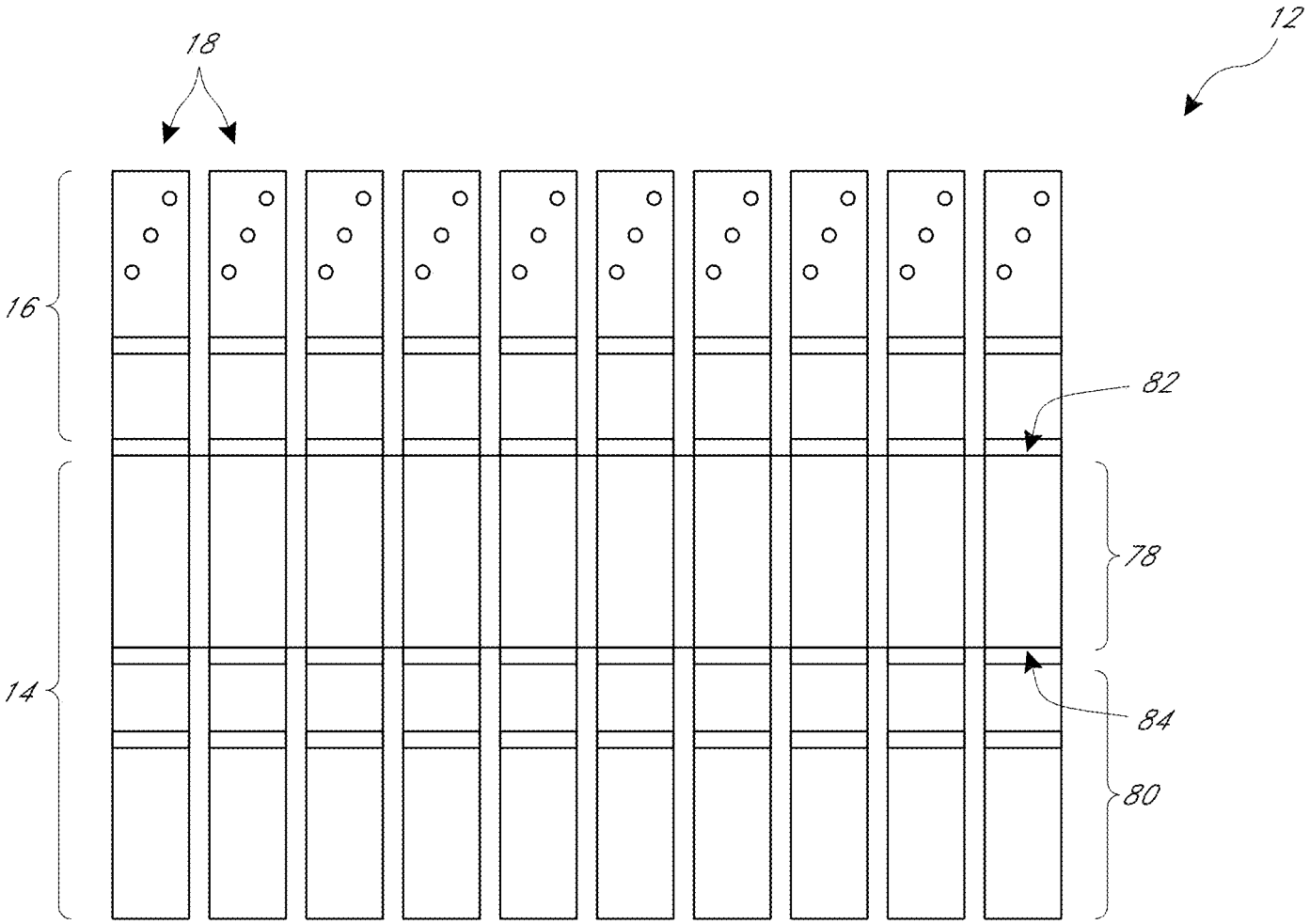
FIG. 19B shows a front view of the flexible substrate used in FIG. 19A in an unfolded state.
Figure 19C:
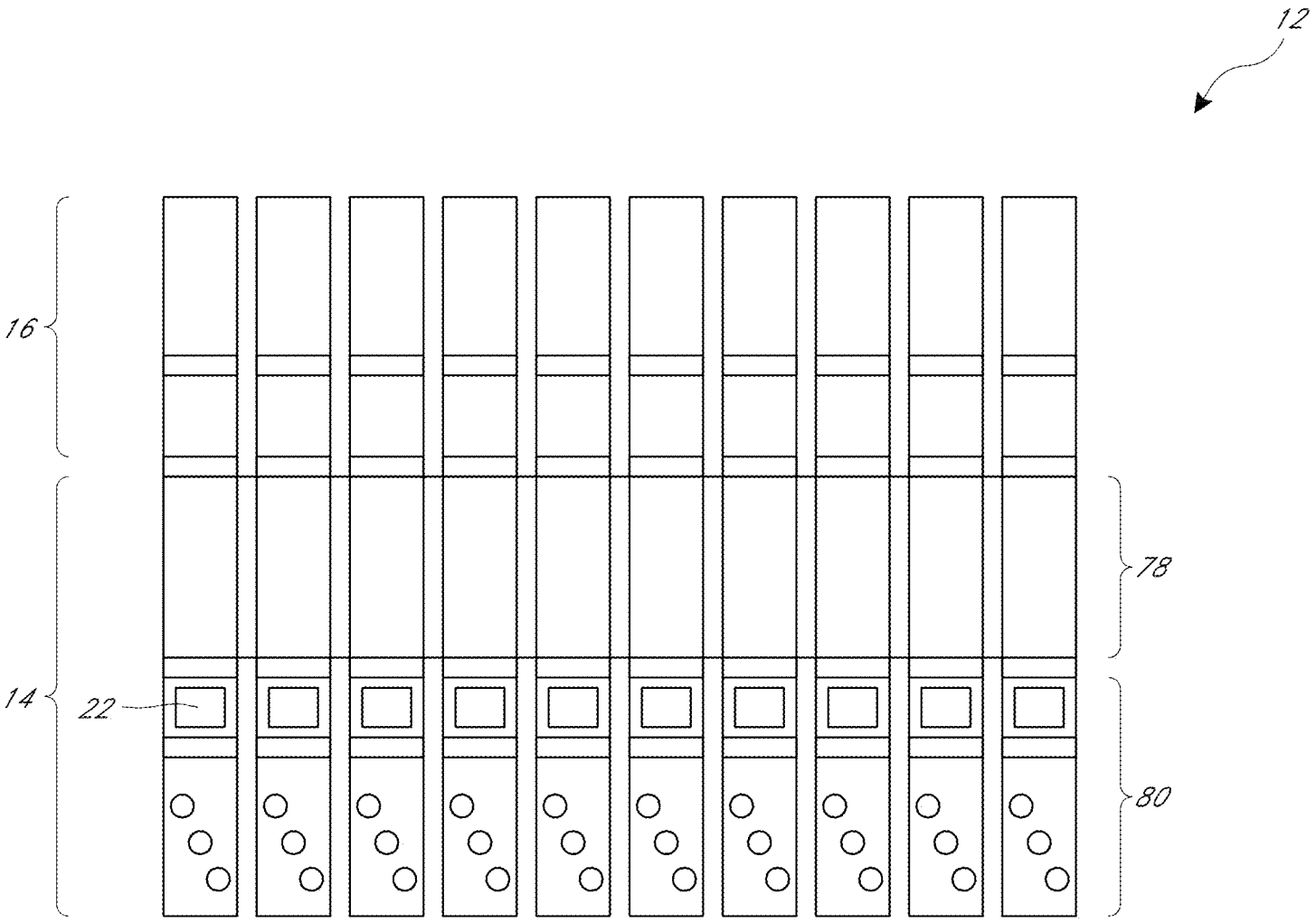
FIG. 19C shows a back view of the flexible substrate used in FIG. 19A in an unfolded state.

FIG. 19A shows another embodiment of an electrical coil structure 1. FIGS. 19B and 19C show front and back side views of the flexible substrate 12 used in FIG. 19A in an unfolded state (before wrapping about an annular magnetic core). Instead of radial segments from a disc-shaped base, the flexible substrate 12 of this embodiment includes base 14 (e.g., first portion) that comprises a linear spine 78 and legs 80 and parallel segments 16 (e.g., second portion) extending from the spine 78 of the base 14. The linear spine 78 comprises a first side 82 from which the segments 16 extend and a second side 84 from which the legs 80 extend. The linear spine 78 is shown in FIG. 19A lining the inner surface (e.g., the inner periphery 11*a*) of an annular (cylindrical) magnetic core 10. The segments 16 at least partially wrap around the core and connected to the corresponding legs 80 of the bases 14 to define at least one coil around the core. In a variation of the embodiment of FIGS. 19A-19C, the base may comprise only a spine (no legs), and the segments extending from one side only, which wrap around the core to connect tips of the segments back to the spine/base. In such an embodiment, the linear spine/base more preferably lines the outer surface of the core such that alignment features and contacts are more readily accessed for alignment and connection (e.g., soldering). Conductors within the segments 16 connect within the base 14 in a manner that defines windings for the electrical coil. In some embodiments, as illustrated in FIG. 19A, the spine 78 can be disposed generally parallel with a surface (e.g., the inner periphery 11*a*) of the magnetic core 10.

In some embodiments, to attach tips 18 of the segments 16 to the legs 80 of the base 14 (or directly to a legless spine/base in other embodiments), one or more of the interlock features disclosed herein may be used. For example, the tips 18 of the segments 16 may comprise protrusions and the legs 80 of the base 14 (or to a legless spine/base in other embodiments) may comprise complimentary cavities or recesses, or vice versa. Additionally or in place of such alignment features, a temporary adhesive may be disposed between the tips 18 of the segments 16 and the legs 80 of the base 14 (or to a legless spine/base in other embodiments). In some embodiments, a redistribution layer may be disposed between the tips 18 of the segments 16 and the legs 80 of the base 14 (or a legless spine/base in other embodiments). In some embodiments, the tips 18 of the segment 16 may have an edge contact to facilitate visual inspection of the permanent bond (e.g., solder connection). Through holes and guide pins may also or alternatively be employed to connect tips 18 of the segments to the base 14 in alignment for electrical connection.

A skilled artisan would appreciate applying any one or more of the alignment guide (e.g., interlock or temporary adhesion) features disclosed herein with any other embodiments disclosed herein, such as an embodiments with edge contact at the tips of the substrate and/or with the redistribution substrate.

Although disclosed in the context of certain embodiments and examples, it will be understood by those skilled in the art that the present invention extends beyond the specifically disclosed embodiments to other alternative embodiments and/or uses and obvious modifications and equivalents thereof. In addition, while several variations have been shown and described in detail, other modifications, which are within the scope of this disclosure, will be readily apparent to those of skill in the art based upon this disclosure. It is also contemplated that various combinations or sub-combinations of the specific features and aspects of the embodiments may be made and still fall within the scope of the present disclosure. It should be understood that various features and aspects of the disclosed embodiments can be combined with, or substituted for, one another in order to form varying modes of the disclosed invention. Thus, it is intended that the scope of the present invention herein disclosed should not be limited by the particular disclosed embodiments described above, but should be determined only by a fair reading of the aspects that follow.

The invention claimed is:

1. An electric coil structure, comprising:

a magnetic core;

a coil substrate comprising a conductive material embedded in an insulating material, the coil substrate having a first portion and a second portion, the first portion of the coil substrate at least partially wrapped around the magnetic core, the conductive material of the first portion comprising a plurality of conductive lines at least partially separated from one another by a portion of the insulating material; and an alignment structure, the alignment structure configured to facilitate electrical connection using a conductive adhesive between the conductive material of the first portion and the conductive material of the second portion to define a coil about the magnetic core.

2. The electric coil structure of claim 1 is a transformer.

3. The electric coil structure claim 1, wherein the electric coil structure comprises a surface mount electronic device.

4. The electric coil structure of claim 1, wherein the magnetic core has an annular shape and the coil substrate comprises polyimide.

5. The electric coil structure of claim 1, wherein the alignment structure comprises recesses at the first portion and protrusions at the second portion disposed in the corresponding recesses.

6. The electric coil structure of claim 1, wherein the alignment structure comprises a temporary adhesive layer disposed between the first portion and the second portion, the temporary adhesive layer comprises Ajinomoto Bonding Film (ABF) or Temperature Sensitive Adhesive (TSA).

7. The electric coil structure of claim 1, wherein the alignment structure comprises an alignment hole at a tip of the second portion configured to receive an alignment pin during assembly.

8. The electric coil structure of claim 1, wherein the alignment structure comprises a redistribution substrate disposed between the first portion and the second portion.

9. The electric coil structure of claim 8, wherein alignment structure further comprises a locking feature at an edge of the redistribution substrate.

10. The electric coil structure of claim 1, wherein the alignment structure comprises an edge contact formed on the first portion of the coil substrate.

11. The electric coil structure of claim 1, wherein the coil substrate comprises multiple segments, the second portion of the coil substrate comprises a base and the first portion of the coil substrate comprises the segments extending from the second portion.

12. The electric coil structure claim 1, wherein the coil substrate further comprises a third portion and a fourth portion, the third portion of the coil substrate is at least partially wrapped around the magnetic core, and the alignment structure is further configured to facilitate electrical connection of the conductive material of the third portion to the conductive material of the fourth portion to define the coil about the magnetic core.

13. The electric coil structure of claim 1, wherein the conductive adhesive comprises solder.

14. An electric coil structure, comprising:

a magnetic core;

a coil substrate comprising a conductive material embedded in an insulating material, the coil substrate having a first portion and a second portion, the first portion of the coil substrate at least partially wrapped around the magnetic core, the conductive material of the first portion comprising a plurality of conductive lines at least partially separated from one another by a portion of the insulating material; and a means for at least partially guiding electrical connection by way of a conductive adhesive between the conductive material of the first portion and the conductive material of the second portion to define a coil about the magnetic core.

15. The electric coil structure of claim 14, wherein the means for guiding comprises recesses at the first portion, protrusions at the second portion disposed in the corresponding recesses, and a temporary adhesive layer disposed between the first portion and the second portion.

16. The electric coil structure of claim 14, wherein the means for guiding comprises a redistribution substrate disposed between the first portion and the second portion, and the redistribution substrate comprises a locking feature at an edge of the redistribution substrate.

17. The electric coil structure of claim 14, wherein the coil substrate comprises multiple segments, the second portion of the coil substrate comprises a base and the first portion of the coil substrate comprises the segments extending from the second portion, and the second portion comprises a spine and legs extending from the spine.

18. An electric coil structure, comprising:

a magnetic core;

a coil substrate comprising a conductive material embedded in an insulating material, the coil substrate having a first portion and a second portion, the first portion of the substrate at least partially wrapped around the core;

a conductive adhesive electrically connecting the first portion and the second portion;

a nonconductive material layer disposed between the first portion and the second portion; and a plurality of conductive traces in or on the nonconductive material layer, the conductive traces and the nonconductive material layer defining a redistribution substrate including a first side having a first plurality of contacts and a second side having a second plurality of contacts, the first plurality of contacts electrically connected to the second plurality of contacts through the nonconductive material, sizes of the second plurality of contacts being larger than sizes of the first plurality of contacts, wherein the first portion and the second portion of the coil substrate define at least one winding around the magnetic core.

19. The electric coil structure of claim 18, wherein the nonconductive material layer comprises a nonconductive adhesive that is disposed between the first portion and the redistribution substrate.

20. The electric coil structure of claim 18, wherein the first portion of the coil substrate comprises edge contacts.

21. The electric coil structure of claim 18, wherein the redistribution substrate comprises a recess and the first portion comprises a protrusion disposed in the recess.

* * * * *